US007497989B2

(12) United States Patent
Kennedy et al.

(10) Patent No.: US 7,497,989 B2
(45) Date of Patent: Mar. 3, 2009

(54) MOLTEN METAL PRESSURE POUR FURNACE

(75) Inventors: Gordon F. Kennedy, Sarasota, FL (US); Mark G. Mohler, Moraine, OH (US)

(73) Assignee: HI T.E.Q., Inc., Columbus, OH (US)

( * ) Notice: Subject to any disclaimer, the term of this patent is extended or adjusted under 35 U.S.C. 154(b) by 0 days.

(21) Appl. No.: 11/862,735

(22) Filed: Sep. 27, 2007

(65) Prior Publication Data

US 2008/0011787 A1 Jan. 17, 2008

Related U.S. Application Data

(62) Division of application No. 10/382,150, filed on Mar. 5, 2003, now Pat. No. 7,279,128.

(60) Provisional application No. 60/413,183, filed on Sep. 24, 2002, provisional application No. 60/410,408, filed on Sep. 13, 2002.

(51) Int. Cl.
*B22D 39/06* (2006.01)

(52) U.S. Cl. ..... 266/239; 266/45; 222/595

(58) Field of Classification Search ..... 266/239, 266/45; 222/595

See application file for complete search history.

(56) References Cited

U.S. PATENT DOCUMENTS

| | | | |
|---|---|---|---|
| 1,448,529 | A | 3/1923 | Fleming |
| 2,185,376 | A | 1/1940 | McParlin |
| 3,084,925 | A | 4/1963 | Stauffer et al. |
| 3,708,088 | A | 1/1973 | Lesher |
| 3,996,412 | A | 12/1976 | Schaefer et al. |
| 4,027,862 | A | 6/1977 | Schaefer et al. |
| 4,220,319 | A | 9/1980 | Rohmann |
| 5,477,907 | A | 12/1995 | Meyer et al. |
| 5,590,681 | A | 1/1997 | Schaefer et al. |
| 5,725,043 | A | 3/1998 | Schaefer et al. |
| 5,913,358 | A | 6/1999 | Chadwick |
| 6,103,182 | A | 8/2000 | Campbell |

(Continued)

FOREIGN PATENT DOCUMENTS

WO WO 02/102531 A1 10/2007

*Primary Examiner*—Scott Kastler
(74) *Attorney, Agent, or Firm*—Philip O. Post

(57) ABSTRACT

An apparatus and process are provided for discharging a dose of a molten metal from a pressure pour furnace. A heating chamber of the furnace is used to keep the molten metal at a selected temperature. A sealing port between the heating chamber and a pressure chamber allows selectively filling of the pressure chamber with molten metal from the heating chamber by inserting or removing a sealing means from the sealing port. The sealing means inserted in the sealing port also provides a means for preventing back flow of the molten metal to the heating chamber when the pressure chamber is pressurized. Differential pressure sensing of the pressure of the molten metal in the pressure chamber and the pressure of the pressurizing gas in the pressure chamber can optionally be used to achieve an accurate measured discharge from the pressure chamber as the level of molten metal decreases from repeated discharges of doses from the furnace. The sealing plate in which the sealing port is disposed and the sealing means selectively inserted or removed from the sealing port can be used as a metering valve between two molten metal containing components such as a launder and a pressure chamber of a pressure pour furnace.

25 Claims, 20 Drawing Sheets

U.S. PATENT DOCUMENTS 6,152,159 A 11/2000 Miller et al.
6,341,640 B1 1/2002 Iversen et al.
6,505,677 B1 1/2003 Iversen et al.
6,841,120 B2 * 1/2005 Grassi et al. ..... 266/239

* cited by examiner

MOLTEN METAL PRESSURE POUR FURNACE

CROSS REFERENCE TO RELATED APPLICATIONS

This is a divisional application of application Ser. No. 10/382,150, filed Mar. 5, 2003 now U.S. Pat. No. 7,279,428, which application claims the benefit of U.S. Provisional Application No. 60/410,408, filed Sep. 13, 2002, and U.S. Provisional Application No. 60/413,183 filed Sep. 24, 2002, all of which applications are incorporated herein by reference in their entireties.

FIELD OF THE INVENTION

The present invention relates generally to molten metal pressure pour furnaces, and in particular, to such furnaces wherein a repeatedly precise dose of molten metal is discharged from the furnace. The present invention further relates to a molten metal flow valve that can be used with molten metal pressure pour furnaces.

BACKGROUND OF THE INVENTION

Pressure pour or dosing furnaces can be used to discharge repeated and measured doses of a molten metal from the furnace for filling a continuous line of molds. The opening to the sprue of a mold is brought in contact with the outlet of the furnace and a gas is used to exert pressure on the molten metal in the furnace, which forces a measured dose of the melt into the sprue, through the gating system and into the mold cavities. Molds can be sequentially filled in the process.

U.S. Pat. No. 4,220,319 to Rohmann discloses a single chamber pressure pour furnace. A metered discharge from the furnace is accomplished by differential pressure sensing of air in the pressurized chamber. The pressure at which molten metal in the chamber rises to the end of the outlet tube prior to each discharge is sensed. This pressure reading is used as the baseline pressure at the start of a pour. The pour is terminated by release of pressure in the chamber when the chamber pressure reaches a selected value.

U.S. Pat. No. 5,477,907 to Meyer et al discloses a pressure chamber that is isolated from a heating chamber by a wall with an opening through it. A backloading air regulator is used to account for the pressure increase in the pressure chamber that is required for the molten metal to rise to the end of the outlet tube before the timed period of discharge is started. Further backflow of molten metal into the heating chamber is allowed through the opening in the wall when the pressure chamber is pressurized.

U.S. Pat. No. 5,913,358 to Chadwick discloses the use of a non-return valve in the wall between the pressure chamber and heating chamber to prevent the backflow of molten metal when the pressure chamber is pressurized. The non-return valve is disclosed typically as a ball and socket valve that acts automatically to prevent reverse flow. A potential disadvantage of this arrangement is that the molten metal, or particulate in the melt, could lodge the ball in a position that permanently blocks flow of the molten metal from the heating chamber to the pressure chamber as required to replenish the supply of melt in the chamber.

U.S. Pat. No. 5,590,681 to Schaefer et al. discloses a plug valve assembly integral with upstream and down stream launder sections. The upstream launder section is connected to a low pressure casting furnace, and the upstream launder section is connected to a supply of molten metal. Flow between the supply and the low pressure casting furnace is controlled by the plug valve assembly.

One object of the present invention is to provide a pressure pour furnace wherein the pressure differential between the molten metal at a selected level in the pressure chamber and the pressurized gas used to perform a pressure pour in the pressure chamber is used to provide a repeatedly precise measured discharge of melt from the furnace. Another object of the present invention is to control the flow of molten metal to the pressure chamber of a pressure pour furnace with a compact metering valve arrangement that will also provide an efficient method of blocking backflow of the molten metal from the pressure chamber into the heating chamber, or metal supply chamber, when the pressure chamber is pressurized.

BRIEF SUMMARY OF THE INVENTION

In one aspect, the present invention is an apparatus for, and method of, discharging a dose of molten metal, or melt, from a furnace comprising a receiving chamber, heating chamber and pressure chamber. Molten metal is supplied to the receiving chamber; maintained at a desired temperature in the heating chamber; and discharged from the pressure chamber. A sealing plate having a sealing port in it is disposed between the heating chamber and the pressure chamber to control the flow of melt from the heating chamber to the pressure chamber by the insertion or removal of a sealing means in the sealing port. Insertion of the sealing means in the sealing port also prevents the back flow of melt from the pressure chamber to the heating chamber when the pressure chamber is pressurized. A gas injected into the pressure chamber is used to force the melt from an outlet dosing tube in the pressure chamber and into a suitable container. The dosing tube may be extend from the pressure chamber for connection with a mold for filing and retracted into the pressure chamber after the mold is filled. In one example of the invention, the means for blocking the back flow of melt from the pressure chamber to the heating chamber is a sealing means that substantially blocks the back flow of melt through the sealing port in a composite high thermal conductivity ceramic sealing plate and port.

In another aspect, the present invention is a system for delivering doses of molten metal from one or more molten metal pressure pour furnaces when the molten metal is supplied from one or more metal melting furnaces by a launder network. One or more heat treatment processes may be performed on the molten metal before being delivered to the metal pressure pour furnaces by the launder network.

In another aspect, the present invention is a metering valve that can be formed from a sealing plate that prevents the flow of molten metal between two adjoining molten metal containing components such as a launder and the pressure chamber of a pressure pour furnace. The sealing plate has a sealing port disposed in it to allow the flow of molten metal when a sealing means is not inserted in the sealing port and to prevent the flow of molten metal when the sealing means is inserted in the sealing port.

These aspects of the invention are further set forth in this specification, and other aspects of the invention are as set forth in this specification.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 6(*b*) and FIG. 6(*c*) illustrate one example of a dosing tube and dosing tube assembly used in the pressure chamber of a molten metal pressure pour furnace of the present invention.

FIG. 9(*b*) diagrammatically illustrates an integrated arrangement of molten metal supply sources, molten metal heat treatment vessels and a plurality of the metering valves of the present invention that are used to regulate the flow of a molten metal into a plurality of low pressure furnaces.

FIG. 10(*b*) diagrammatically illustrates an integrated arrangement of molten metal supply sources, molten metal heat treatment vessels and a plurality of the double metering valve arrangements of the present invention that are used to regulate the flow of a molten metal into a plurality of low pressure furnaces.

DETAILED DESCRIPTION OF THE INVENTION

Figure 1:
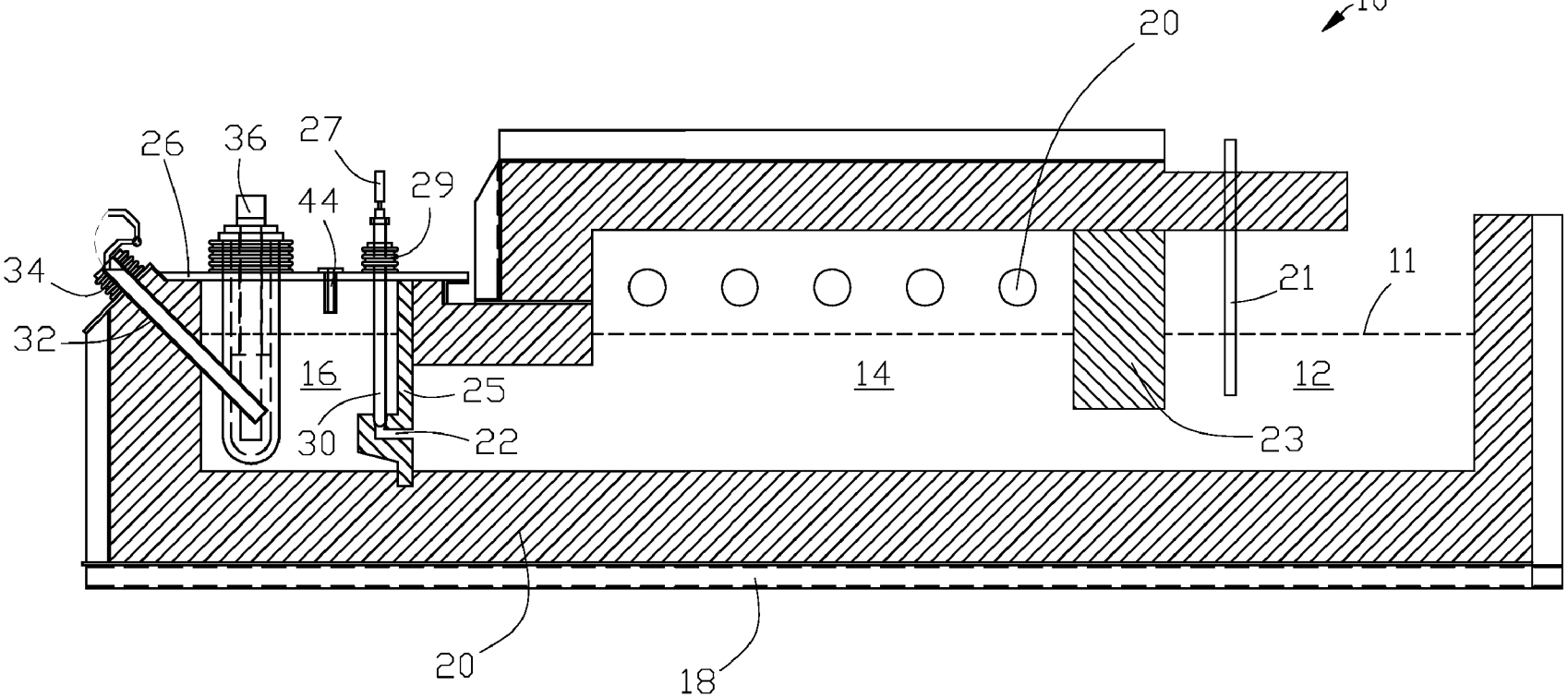
FIG. 1 is a cross sectional view of one example of the molten metal pressure pour furnace of the present invention.
Figure 2:
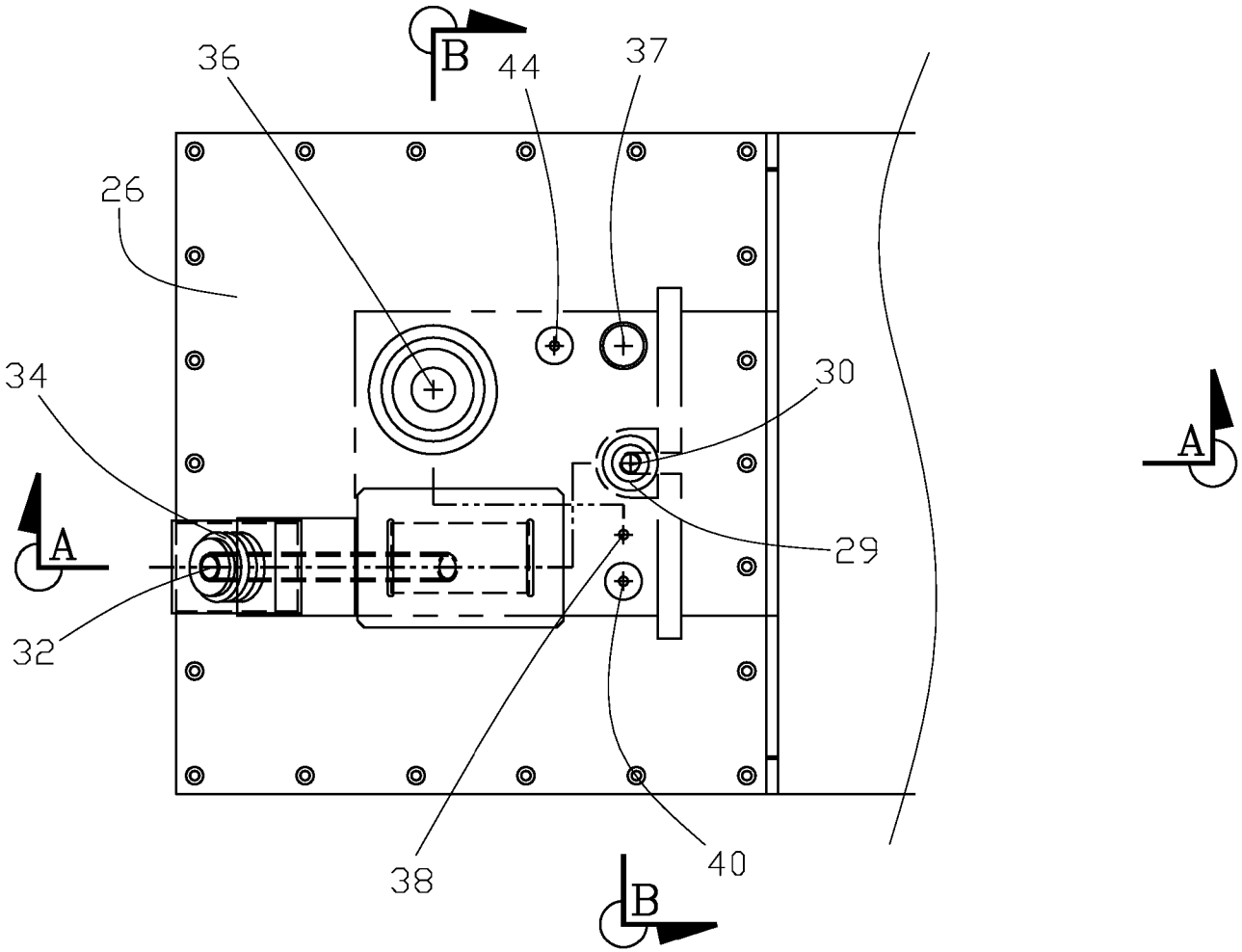
FIG. 2 is a top view of one example of a pressure chamber used in a molten metal pressure pour furnace of the present invention.

Referring now to the drawings, wherein like numerals indicate like elements, there is shown in the drawings, one example of the molten metal pressure pour furnace 10 of the present invention. The furnace comprises a receiving chamber 12, heating chamber 14 and pressure chamber 16. The furnace's exterior support structure 18 is formed from a suitable material such as a mild steel, and may be lined with a suitable refractory 20 such as multicomponent refractory materials as known in the art. As explained in further detail below: receiving chamber 12 is supplied with molten metal, or melt, from a suitable source; heating chamber 14 maintains the melt at a suitable temperature; and pressure chamber 16 discharges a measured dose of melt from the furnace. When furnace 10 provides molten metal to a continuous line of molds, the pressure chamber usually holds a sufficient quantity of melt for filling multiple molds in succession. When required the molten metal in the pressure chamber is replenished with melt from the heating chamber. Molten metal load line 11 (shown as a dashed line) in FIG. 1 illustrates a typical fully loaded furnace.

Receiving chamber 12 can be supplied with molten metal, such as, but not limited to, a liquid aluminum composition, by a suitable pumping system or launder. In one example of the invention, the supply of melt is provided by a launder delivery system connected to a melt and metal treatment system wherein the launder delivery system maintains a substantially constant level of molten metal in the receiving chamber. For example, aluminum ingots and scrap may be melted in a stack furnace to produce liquid aluminum that is collected in a holding furnace. The liquid aluminum may be further treated to remove hydrogen gas, oxides, impurities and other active metals in a filtering vessel that is fed from the holding furnace. Either a gravity feed or pumped launder delivery system may be connected between the holding furnace or filtering vessel and receiving chamber 12. A means for sensing the level of molten metal in the receiving chamber or launder delivery system, such as a laser sensing system or mechanical float switch, can be used to sense the level of melt for control of the flow of molten metal from the holding furnace or filtering vessel to the receiving chamber so that a substantially constant height of melt is continuously maintained in the receiving chamber. Receiving chamber 12 may also include means for degassing the melt in the chamber, such as a carbon diffusion lance, floor purge plugs or a rotary dispersion lance top, as used to inject chlorine gas, nitrogen or argon into liquid aluminum. Further the launder delivery system may be arranged so that a single supply of melt is distributed to a plurality of pressure pour furnaces.

Heating chamber 14 is partially separated from receiving chamber 12 by furnace arch 23 which is formed from a suitable refractory composition. Heating chamber 14 includes suitable means for heating melt in the chamber, such as electric heating elements 20, or fossil fuel fired burners. Fossil fuel fired burners are less advantageous in that combustion gas byproducts may contaminant melt in the heating chamber. Suitable resistive electric heating elements are preferably of a high watt density type such as those formed from a silicon carbide composition. Furnace arch 23 serves as a means for retaining heat and a protective atmosphere within the heating chamber, and prevents any melt perturbations in the receiving chamber from propagating into the heating chamber. Normally the heights of the melt in the receiving and heating chambers are the same. Heating elements 20 are a part of a furnace heating system that maintains a pre-selected temperature of the molten metal in the heating chamber. One or more means for sensing temperature of the melt in the furnace, such as immersed thermocouple 21 is used as an input to a processing means, such as a programmable logic controller (PLC). The processing means provides an output signal to the means for heating the molten metal in the heating chamber. For example, if electric resistive heating elements are used, the output signal may be used to control the switching of silicon controlled rectifiers (SCRS) in an SCR heater controller. Temperature sensing may include differential temperature sensing of the molten metal in the receiving and heating chambers. Preferably heating chamber 14 includes a non-reactive gas purging system wherein a gas, such as nitrogen, is used to purge the air above the surface of the molten metal in the heating chamber to minimize the formation of oxide on the surface, and minimize the diffusion of contaminants into the molten metal, such as hydrogen gas in liquid aluminum. Optionally porous floor plugs may also be provided in the heating chamber to purge contaminants in the molten metal, such as hydrogen gas in aluminum, by flowing a non-reactive gas, such as nitrogen or argon, through the melt.

Figure 6A:
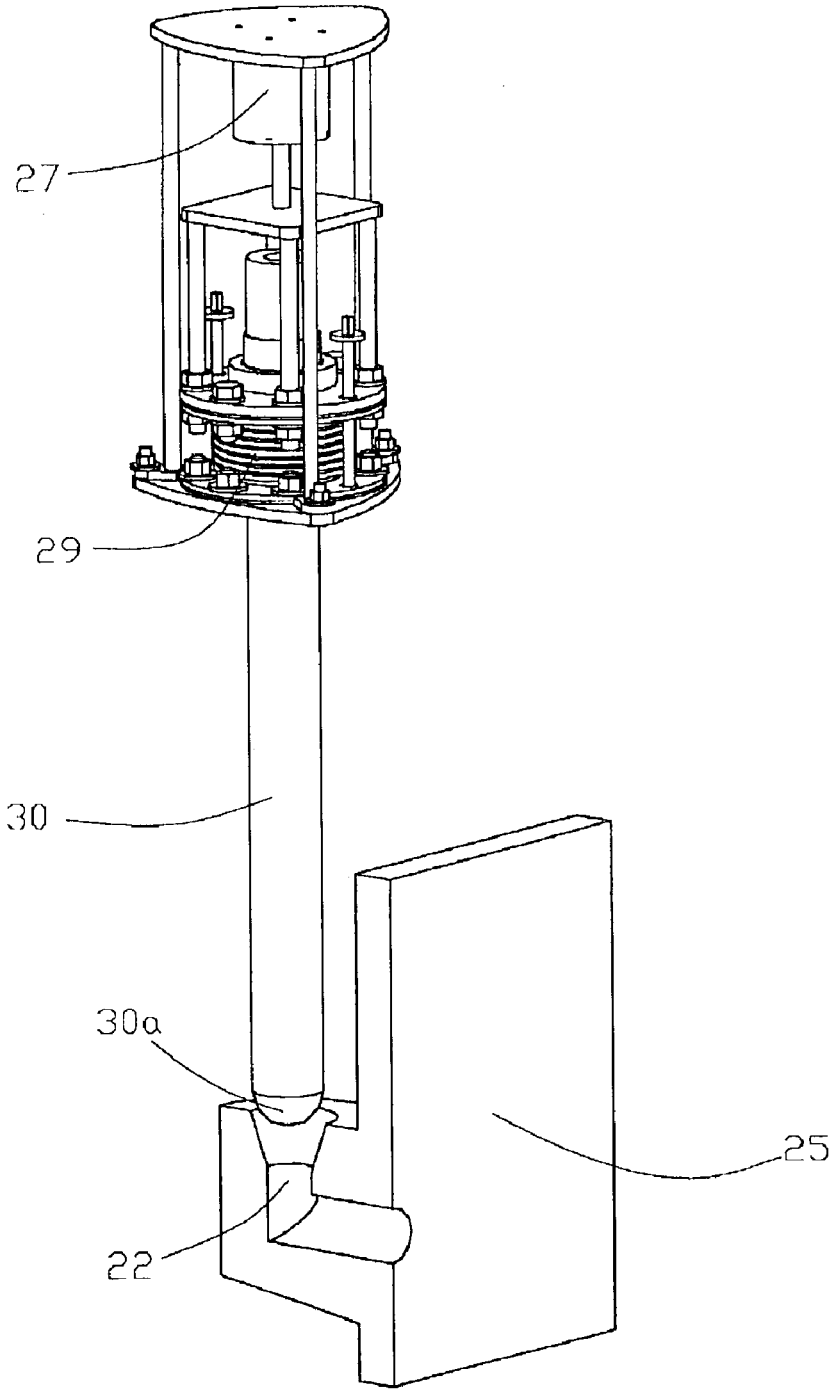
FIG. 6(*a*) illustrates one example of a metering valve used to control flow of a molten metal between adjoining molten metal containing components.
Figure 6B:
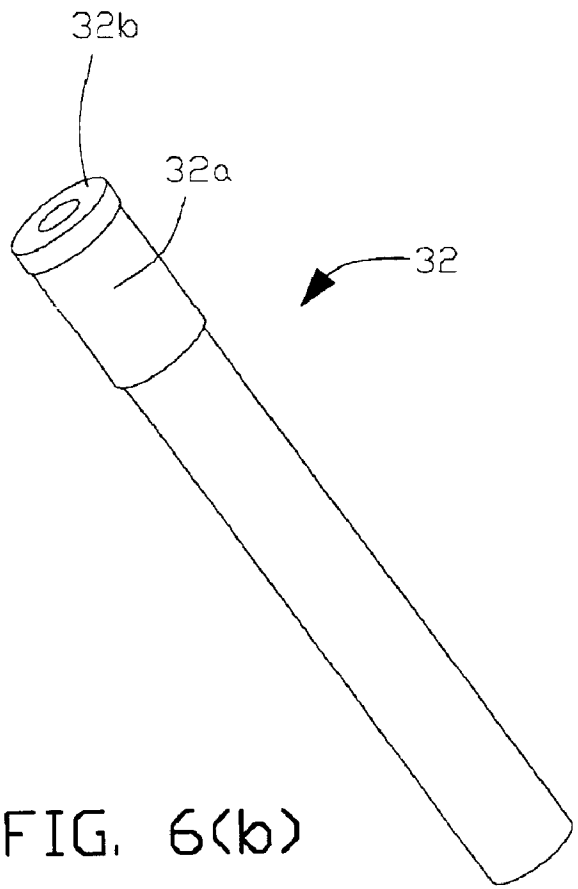
Figure 6C:
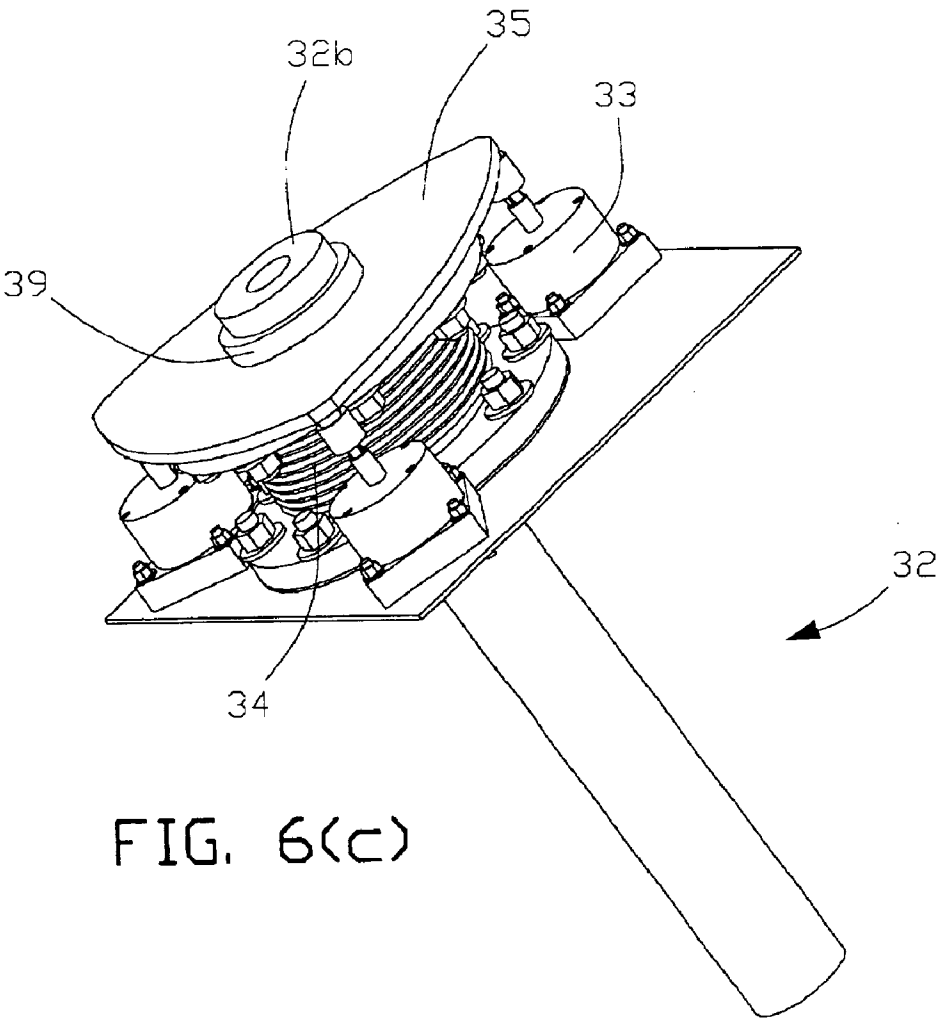

Pressure chamber 16 is separated from heating chamber 14 by a composite sealing plate and port 22 as best illustrated in FIG. 6(*a*). In one non-limiting example of the invention, the composite sealing plate and port is integrally cast from a high thermal conductivity ceramic such as a nitrite bonded silicon carbide or other ceramic composition. Use of such composition is desireable for retaining adequate heat content in the melt in the pressure chamber. Alternatively, the sealing port may be separately fabricated and attached to the sealing plate. The port provides a means for flow of melt from the heating chamber to the pressure chamber. A sealing means for insertion into the sealing port substantially blocks the back flow of molten metal from the pressure chamber to the heating chamber through the port when the pressure chamber is pressurized, as well as blocking flow of the molten metal from the heating chamber to the pressure chamber. The top of pressure chamber 16 is substantially sealed from the ambient environment by a suitable wall or lid 26 and seals around penetrating openings for elements as further described below. The lid may be fabricated from a mild steel plate that is suitably fastened to the pressure chamber.

The means for substantially blocking the back flow of molten metal from the pressure chamber to the heating chamber comprises a sealing means inserted into the sealing port. In this non-limiting example of the invention, the sealing means comprises sealing element 30*a* at one end of sealing tube 30, wherein sealing element 30*a* is generally hemispherical in shape and seats into a generally conically-shaped sealing port to substantially block the back flow of molten metal from the pressure chamber when the pressure chamber is pressurized as further described below. The sealing tube and element may be cast from a heat-resistant and wear-resistant material, such as a nitrite bonded silicon carbide or other ceramic composition.

As shown in the non-limiting example of the metering valve of the present invention in FIG. 6(*a*), sealing port 22 comprises a substantially conically-shaped section at one end of the port with its longitudinal axis generally vertically aligned. The smaller diameter end of the conically-shaped section is connected to a substantially cylindrically-shaped section that is elbow-shaped so that the substantially vertical flow of the melt through the conically-shaped section of an open sealing port is redirected to a substantially horizontal flow at the other end of the sealing port. Conversely flow in the opposite direction first flows through the elbow-shaped section and then through the conically-shaped section of the sealing port. The sealing port is integrally attached to sealing plate 25 in this particular example of the invention. Sealing plate 25 serves as the barrier between two adjoining molten metal containing elements.

Sealing port 22 and the sealing means for allowing or preventing flow of the melt through the port comprise a metering valve that generally controls the flow of melt to adjoining molten metal containing elements. In this particular application, the adjoining molten metal containing elements are the heating chamber and the pressure chamber of a molten metal pressure pour furnace.

Figure 3:
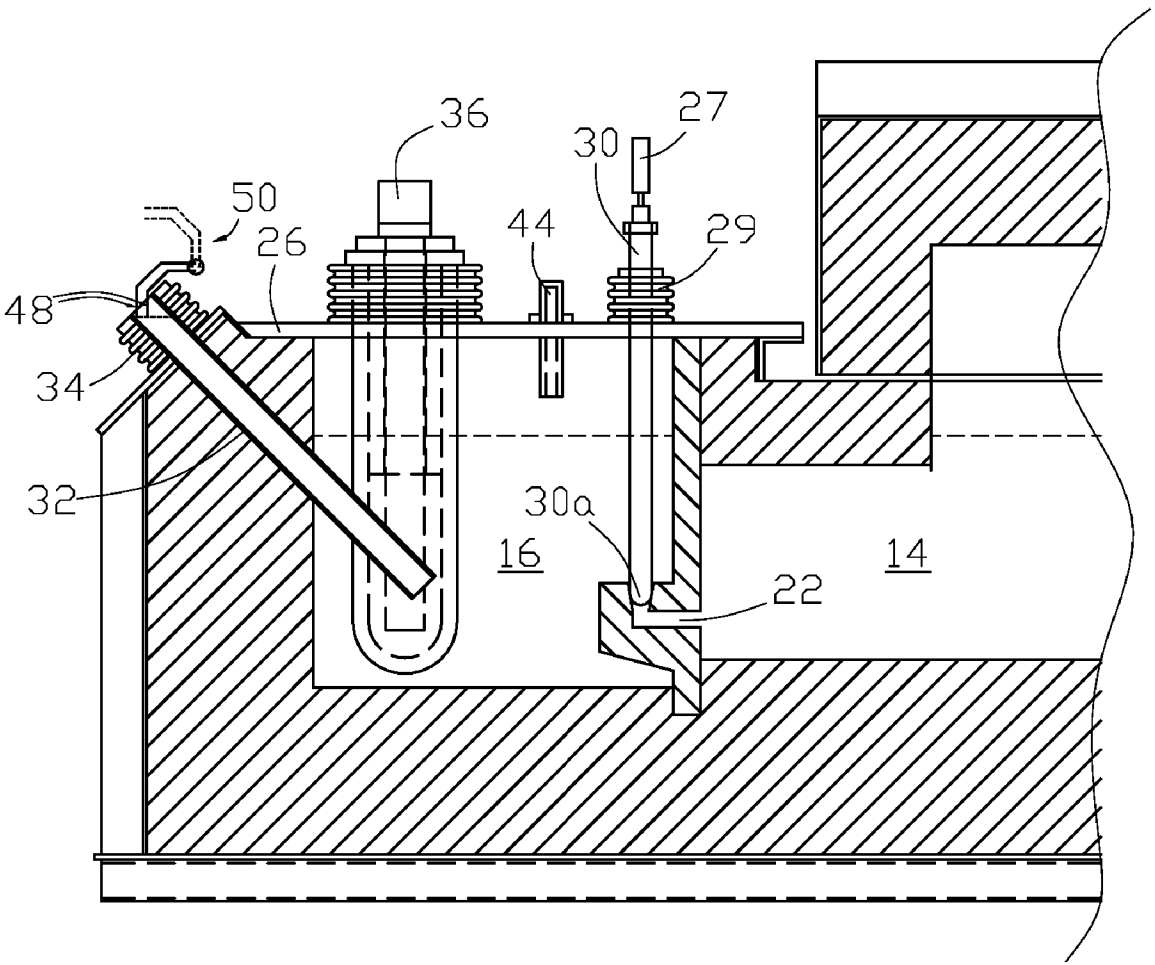
FIG. 3 is a cross sectional view of the pressure chamber illustrated in FIG. 2 at line A-A.

Dosing tube 32 extends obliquely through wall or lid 26 into the molten metal in the pressure chamber and serves as a means for discharging a metered amount of melt from the pressure chamber. In other examples of the invention the orientation of the dosing tube relative to the top wall of the furnace may be different. As shown in FIG. 3, dosing tube sealing bellows 34 surrounds the external end of the dosing tube to provide a pressurized seal around the opening in lid 26 through which the dosing tube penetrates. Use of the bellows allows the pressure seal to be maintained as the dosing tube is extended out of or retracted into the pressure chamber as further described below.

FIG. 6(*b*) and FIG. 6(*c*) illustrate another example of the dosing tube 32 and dosing tube assembly, respectively, of the present invention. In this arrangement, three powered cylinders 33 (one not visible in the drawing) are used to extend and retract dosing tube 32. Bellows 34 extend and retract with the dosing tube to retain the pressurized seal around the dosing tube opening in the wall of the pressure chamber. As further explained below pressure plate 35 makes contact with the surface of a mold when the dosing tube is extended. External end 32*b* of dosing tube 32 inserts into the sprue of a mold when the dosing tube is extended.

Immersion tube heater 36 can be optionally provided to heat melt in the pressure chamber if necessary to compensate for the loss of heat from the melt in the pressure chamber. The auxiliary heater may comprise a resistive silicon carbide heating element disposed within a silicon nitrite tube that penetrates through lid 26 into the molten metal. A thermocouple within the tube can be used to protect against overheating of the heating element. Immersion temperature sensing device 37, such as a high thermal conductivity silicon nitride thermocouple, is used as a sensor for regulating the output of heater 36.

Figure 4:
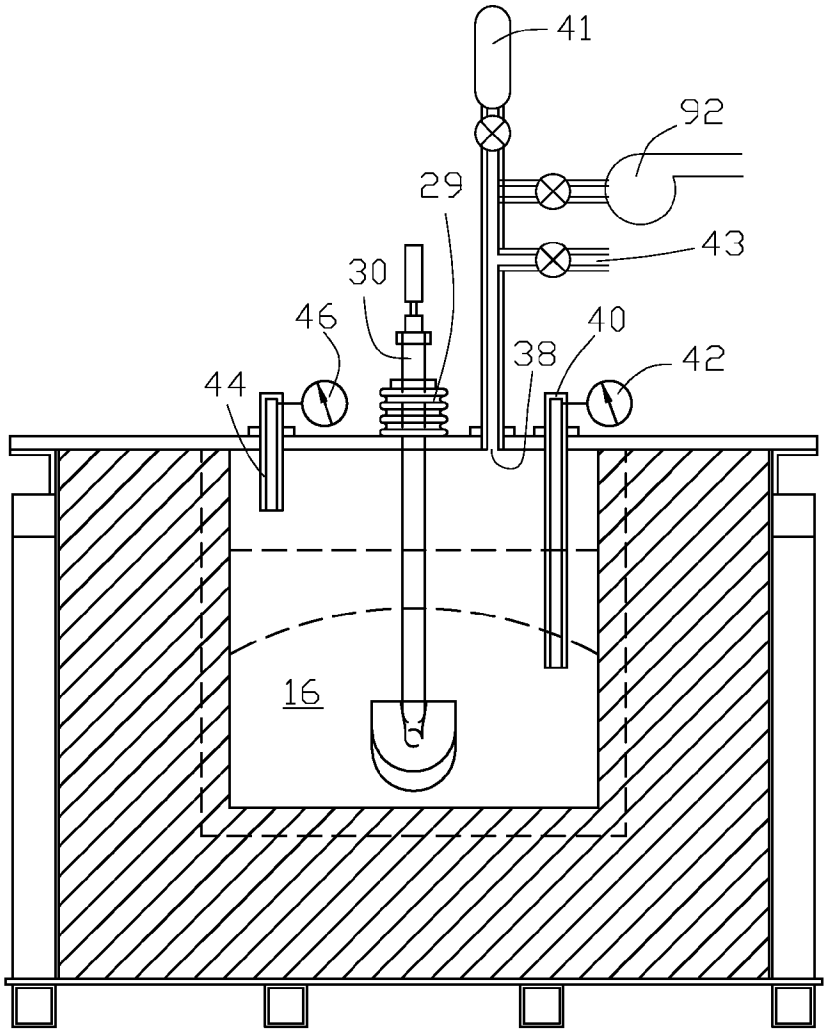
FIG. 4 is a cross sectional view of the pressure chamber illustrated in FIG. 2 at line B-B.

As best seen in FIG. 4, means for pressurizing the molten metal in the pressure chamber is provided by injecting a gas (such as dry air, argon or nitrogen) from a suitable supply 41, under pressure, through gas port 38 located above the surface level of the melt. A means for sensing the dynamic pressure on the molten metal at a pre-selected height in the pressure chamber can be provided by melt pressure sensing tube 40 and melt pressure sensor 42. One non-limiting method of sensing the melt pressure is to bubble a non-reacting gas, such as nitrogen or argon, through the tube at a pressure sufficient to prevent the melt from rising in the melt pressure sensing tube and release a bubble at a predetermined rate. A means for sensing the gas pressure of the gas injected into the dosing chamber can be provided by gas pressure sensing tube 44 and gas pressure sensor 46. Gas exhaust port 43 is provided for controlled release of gas from the pressure chamber to ambient air during the pour process or to depressurize the chamber.

In one non-limiting method of operation, the pressure chamber is substantially filled with melt from the heating chamber to a height equal to the height of the melt in the heating chamber by raising sealing tube 30 with a suitable actuator so that sealing element 30*a* unseats from the sealing port to allow the flow of melt from the heating chamber to the pressure chamber. Sealing tube bellows 29 provides a pressurized seal around the opening through which the sealing tube penetrates into the pressure chamber and allows maintaining the seal as the sealing tube is raised or lowered. After filling the pressure chamber, sealing tube 30 is lowered so that sealing element 30*a* seats in the sealing port to substantially block the back flow of melt into the heating chamber as illustrated in FIG. 3. Optionally a heating element may be provided in sealing element 30*a* to melt any molten metal that may freeze in the sealing tube.

In some examples of the invention, gas is initially injected into the pressure chamber to force melt in the chamber up the dosing tube to approximately the external end of the riser tube. This level of melt, which is referred to as the "ready level" is used as a reference point for the start of every pour from the pressure chamber. The ready level for a particular application may be any height of melt in the dosing tube that is suitable for the process. A means for sensing the presence of the melt at the external end of the riser tube is provided. In one example of the invention, the means comprise a pair of low voltage electrically conducting probes 48 that form a normally open circuit when they are not immersed in molten metal, and a closed circuit when they are immersed in molten metal to indicate that the melt is at the external end of the riser tube. A means is provided to move the probes out of the opening of the riser tube. In this example, the means comprise pivot arm 50, which is shown in the lowered and raised (dashed lines) positions in FIG. 3. In alternate examples of the invention a laser sensor may be used as the means for sensing the presence of the melt at the external end of the riser tube.

Figure 5:
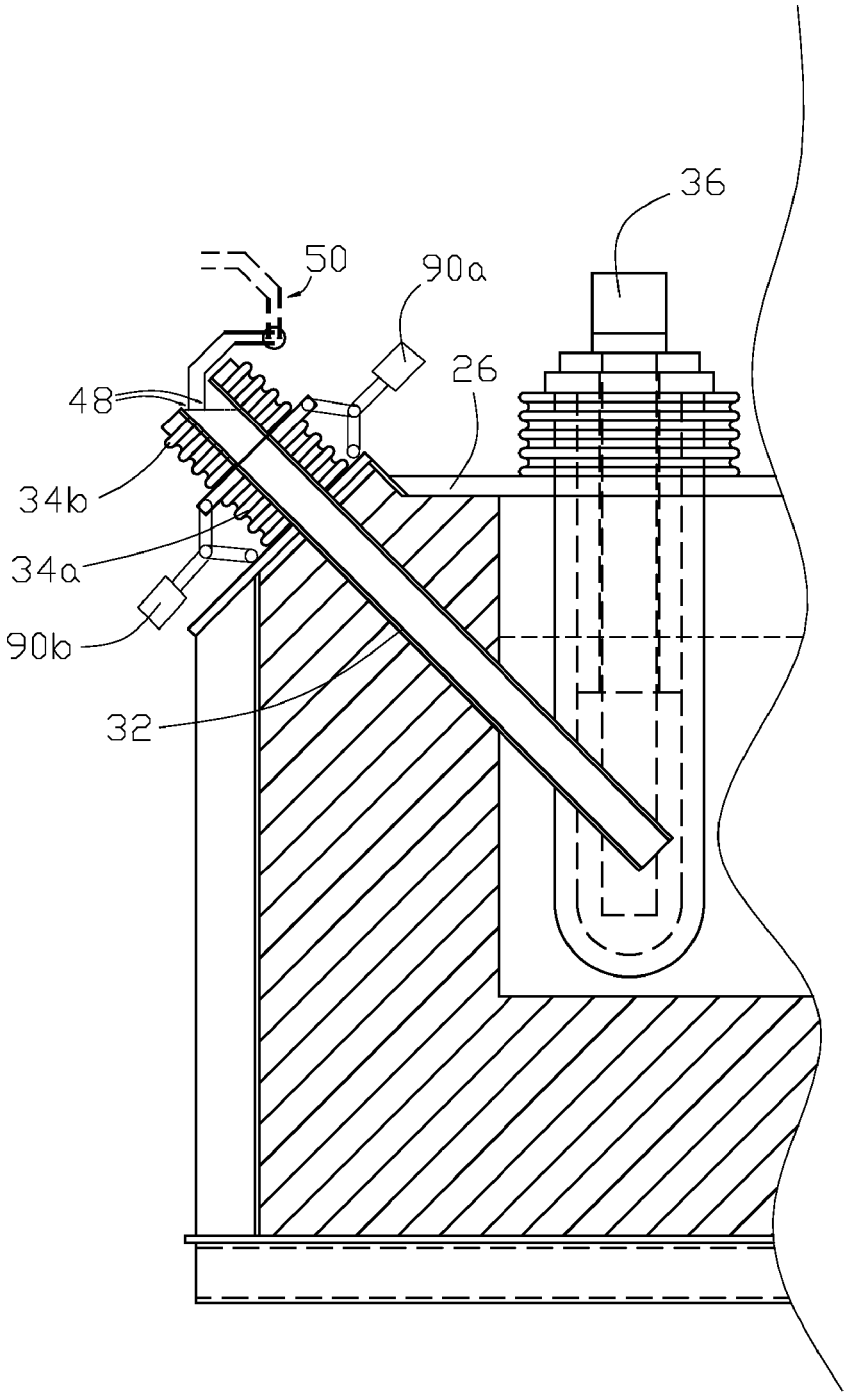
FIG. 5 is a partial cross sectional view of the pressure chamber illustrated in FIG. 4 with the additional feature of a double bellows arrangement around the dosing tube.

Once the melt is raised to the external end of the dosing (riser) tube (or other melt ready level), the opening of a container, such as the opening in a mold sprue, is brought into the vicinity of the external end of the riser tube, with the center of the sprue opening approximately aligned with the center of the opening in the riser tube. Dosing tube 32 is extended out of the pressure chamber by means of a suitable actuator so that a substantially pressurized seal is achieved between the end of the riser tube and the opening in the mold sprue. Dosing tube sealing bellows 34 expands to maintain the pressure seal around the opening through which the dosing tube penetrates when the tube is in its extended position. In some examples of the invention, a double dosing tube bellows arrangement can be used as illustrated in FIG. 5. First dosing tube bellows 34*a* provides a pressurized seal around the dosing tube opening in lid 26. Suitable actuators 90*a* and 90*b*, preferably hydraulic cylinders due to the proximity to molten metal, are used to extend or retract the dosing tube while first dosing tube bellows 34*a* expands or contracts to maintain the seal. Other types of actuators, such as hydraulically or electrically driven actuators, may also be used. Second dosing tube bellows 34*b* compresses as the end of the dosing tube seals around the opening in the mold sprue to absorb any excess pressure exerted by the mating mold surface.

A requisite amount of gas is injected into the pressure chamber to discharge a measured dose of melt into the mold. The volume and time rate of gas injection can initially be established by an algorithm used by the processing means. After pressure pouring the desired amount of molten metal into the mold, the riser tube is retracted into the pressure chamber by means of a suitable actuator. The molds are indexed by moving the filled mold and placing an empty mold in its place. Between mold transitions, probes 48 can be repositioned into the end of the dosing tube to pressurize the pressure chamber to the level required to bring the melt back up to the end of the dosing tube. The empty mold is then filled by the process as described above for the previous mold.

Typically a filled pressure chamber can be used to fill a number of molds, after which the level of melt in the pressure furnace drops to a level that requires replenishment of the melt in the pressure chamber from the heating chamber. One non-limiting method of level sensing of the melt in the chamber can be accomplished as a function of the applied gas pressure in the chamber since increasing applied gas pressure is proportional to the level of melt in the chamber. When replenishment is required, sealing tube 30 is raised to allow a refill of the pressure chamber. Gas exhaust port 43 is normally open when melt flows from the heating chamber to the pressure chamber through the sealing port during a refill. In alternative examples of the example, vacuum pump 92 can be used to draw a vacuum on the pressure chamber to increase the refill flow rate through the sealing port. This is of particular advantage when a slower refill rate will not support a fast indexing speed of molds. In other examples of the invention, a gas may be injected under pressure into the volume above the melt in heating chamber 14 to increase the refill flow rate through the sealing port. If the heating chamber includes the optional non-reactive gas purging system as described above, the purging system may include means for gas pressurizing the melt in the heating chamber. Pressurization of the melt in the heating chamber for increased refill flow rate may optionally be combined with vacuum draw on the pressure chamber. When the melt in heating chamber 14 is under pressure, furnace arch 23 seals the gas volume in the heating chamber from ambient air pressure. In alternate examples of the invention, means may be provided for sealing receiving chamber from ambient air pressure when melt in the heating and/or receiving chamber is pressurized with a gas.

Use of the differential pressure method in some examples of the invention enables accurate control of the measured dose from the riser tube as the quantity of melt in the pressure chamber reduces and the magnitude of applied pressure must increase. The algorithm for pressure control may be adaptively adjusted for future pours into the same type of mold by feedback of the sensed differential pressure during the previous pour.

FIG. 8(*a*) through FIG. 8(*h*) illustrate one non-limiting example of a process control flowchart routine that can be used to discharge molten metal from a pressure pour furnace of the present invention. The process control routine can be programmed by one skilled in the art for execution by a suitable processor and supporting computer hardware and software, and input and output control devices. Starting on FIG. 8(*a*), with pressure chamber 16 vented to atmosphere, sealing port 22 open, and the pressure chamber filled with melt, subroutine 102 is executed to energize the sealing tube close actuator. The sealing tube close actuator may be any suitable drive device for inserting sealing element 30*a* into the sealing port. In this particular example of the invention, the sealing tube actuator is pneumatically driven cylinder 27. While the sealing element is moving to a seated position in the sealing port, subroutine 104 is executed to sense whether there is a blockage in the sealing port that prevents the sealing element from properly seating in the sealing port. Blockage can be sensed by back force loading (in this example, back air pressure) on the sealing tube actuator. If a blockage is sensed, subroutine 106 activates a back pressure stop alarm that can be arranged to stop the process operation and alert an operator to the abnormal condition for correction of the abnormal condition. The sealing element continues to move into the sealing port until subroutine 108 senses that the sealing port closed limit switch has been activated. The sealing port closed limit switch may be a mechanical limit switch mounted on the sealing tube assembly external to the pressure chamber. The sealing port closed limit switch changes state when the sealing element has completed full travel into the sealing port and the de-energize sealing tube close actuator subroutine 110 is executed to stop the actuator. At this time, subroutine 112 may be executed to make a check of all systems alarms, such as a low temperature alarm for melt in the pressure chamber. If any alarm flag is in the alarmed state, then subroutine 114 activates a safety stop switch and subroutine 118 provides an appropriate alarm indication to the operator. After appropriate operator action, subroutine 120 clears the alarm, and the operator de-activates the safety stop switch so that subroutine 121 can return to the main process routine. If the alarm status is clear, then subroutine 122 is executed to seal the pressure chamber from atmospheric pressure. This can be accomplished by closing gas exhaust port 43 and injecting gas into the pressure chamber from gas supply 41

Gas is injected into the pressure chamber until the melt is raised in dosing tube 32 to a level that is designated as the "ready level". Alternative, and possibly a combination of, methods may be used to sense the melt reaching the ready level. As illustrated in FIG. 8(*c*) one method is by laser sensing of the height of the melt in the dosing tube. The laser source is mounted external to the pressure chamber and the laser beam is aimed at the opening of the dosing tube. Subroutine 126 executes repeated measurements of the laser beams "bounce back" time off of the surface of the melt in the tube to determine the height of the melt in the dosing tube. When the height reaches the designated ready level, subroutine 132 holds the gas pressure at the melt ready level. Alternatively, or in combination with laser sensing, subroutine 128 can execute a "bubble tube" ready level sensing. Bubble tube ready level sensing involves slowly injecting a gas down melt pressure sensing tube 40 until melt pressure sensor 42 senses a slow pulse rate (e.g., approximately one pulse per second) air supply, which indicates a slow bubble release of the gas into the melt at the end of the sensing tube 40 immersed in the melt. The pressure at that point in the melt is calibrated to the bubble release rate, and the ready level of melt in the dosing tube can be calculated in subroutine 128 from this pressure, the geometry of the pressure vessel and the volume of melt discharged in each dose of melt from the furnace. When the bubble tube ready level sensing rate indicates the designated ready level, subroutine 132 holds the gas pressure at the melt ready level. Alternative to the laser sensing method is wire probe sensing of the ready level. For this method subroutine 130 moves conducting probes 48 into the external end of the dosing tube so that the tips of the two unconnected probes are at the melt ready level. When melt rises up to the tips of the two probes, the melt completes an electrical circuit that outputs a signal indicating that the ready level has been reached. At this point subroutine 132 holds the gas pressure at the melt ready level.

With melt held at the ready level in the pressure chamber, subroutine 133 is executed to sense whether a mold has been indexed for filing by the mold line machinery. When subroutine 133 receives a signal from the mold line machinery that a mold has been indexed for filing, subroutine 134 energizes the dosing tube extend actuator. The dosing tube extend actuator may be any suitable drive device for extending the dosing tube for mating with the sprue of a mold. In the example of the invention shown in FIG. 6(*c*), the sealing tube actuator is three pneumatically driven cylinders 33. The dosing tube continues to extend toward the surface of the indexed mold until subroutine 136 senses that the end of the dosing tube has made contact with the mold to ensure a sufficient seal between the end of the dosing tube and the sprue of the mold so that there is no leakage of melt from the connection when melt is injected into the sprue of the mold. Pressure sensing can be accomplished by utilizing a pressure load sensor behind pressure plate 35 in the non-limiting example of the invention shown in FIG. 6(*c*). When the sensed pressure reaches a preset level for sufficient sealing, de-energize dosing tube extend actuator subroutine 138 is executed to stop the actuator.

Subroutine 140 injects more gas into the pressure chamber in accordance with a predetermined mold fill profile. For example, one or more pressure levels over discrete time periods may be achieved during a mold fill profile according to mold configurations and the remaining amount of melt in the pressure chamber. Once the mold fill profile has executed subroutine 142 initiates subroutine 144 to release gas from the pressure chamber and return the melt in the chamber to the ready level. As illustrated in FIG. 8(*f*) bubble tube ready level sensing subroutine 148, as previously described, may be used to determine when the melt has returned to ready level. Subroutine 150 holds the melt at the ready level. In addition to bubble tube sensing, after the mold line machinery moves the indexed filled mold away from the external end of the dosing tube and before the next unfilled mold is moved into the indexed position for fill, laser sensing and/or wire probe sensing may be used in lieu of bubble tube ready level sensing, or as a supplement to bubble tube ready level sensing.

Subroutine 152 determines whether a refill (recharge) of melt in the pressure chamber is required. Typically this is predetermined based upon the volume of the cavities in the molds being filled and the capacity of the pressure chamber. However, in other examples of the invention, a direct means of sensing the level of melt in the pressure chamber may be utilized. If a recharge is not required, subroutine 154 energizes the dosing tube retract actuator. The dosing tube continues to retract away from the surface of the indexed mold until subroutine 156 senses that the dosing tube has fully retracted, when subroutine 158 de-energizes the dosing tube retract actuator. Full retraction of the dosing tube may be accomplished by the use of a mechanical limit switch on the external dosing tube assembly. Execution of subroutine 160 blows a stream of air across the external opening of the dosing tube to remove any remnant of melt from the mold fill, and subroutine 162 sends a signal to the mold line machinery that the indexed mold has been filed. At this point the process returns to subroutine 133 on FIG. 8(*d*) to wait for the next empty mold to be indexed for filing from the furnace.

If subroutine 152 determines that a recharge of melt in the pressure chamber is required, as illustrated in FIG. 8(*h*), while subroutines 164, 166, 168, 170 and 172 are being executed for retracting the dosing tube and sending an indexed mold filled signal to the mold line machinery, subroutine 174 brings the pressure chamber to atmospheric pressure, for example, by opening gas exhaust port 43. Then subroutine 176 is executed to energize the sealing tube open actuator. The sealing element continues to move away from the sealing port until subroutine 178 senses that the sealing port opened limit switch has been activated. The sealing port opened limit switch may be a mechanical limit switch mounted on the sealing tube assembly external to the pressure chamber. The sealing port opened limit switch changes state when the sealing tube element has fully moved to the open position and the de-energize sealing tube open actuator subroutine 180 is executed to stop the actuator. Ideally when the sealing port 22 is opened, melt will flow into the pressure chamber until it reaches a melt level equal to that in the heating chamber. However, the speed of the mold line machinery may index an empty mold for filling before a complete refill of the pressure chamber, and in order to not delay the rate of mold filling, a less than full recharge of the pressure furnace may be accomplished. Subroutine 184 determines whether the recharge of the pressure chamber is complete. The determination may be based upon the amount of time that the sealing port is open, or in other examples of the invention, direct sensing of the melt level in the pressure chamber may be utilized. Subroutine 184 passes process control to subroutine 102 in FIG. 8(*a*) when recharge of the pressure chamber has been accomplished, and the mold filing process continues. In some examples of the invention, extension and retraction of the dosing tube is not required if the dosing tube is feeding a fixed launder as further described below. For these examples of the invention, the non-limiting example of a process control of the present invention illustrated in FIG. 8(*a*) through FIG. 8(*h*) are suitably modified to accommodate a fixed dosing tube.

Alternative examples are contemplated within the scope of the invention. For example, rather than pressure discharging the measured melt directly into a mold from furnace 10, the discharge may be to an intermediate reservoir from which a container is filled by gravity release of melt from the reservoir. Alternatively the discharge may be to a launder that gravity feeds the molten metal into a mold. In some examples of the invention it may not be necessary to extend and retract the dosing tube. In these examples, the dosing tube sealing bellows may or may not be used. Further contemplated within the scope of the invention is the disclosed features of the pressure chamber in combination with a heating chamber and/or a receiving chamber of various configurations.

Figure 7:
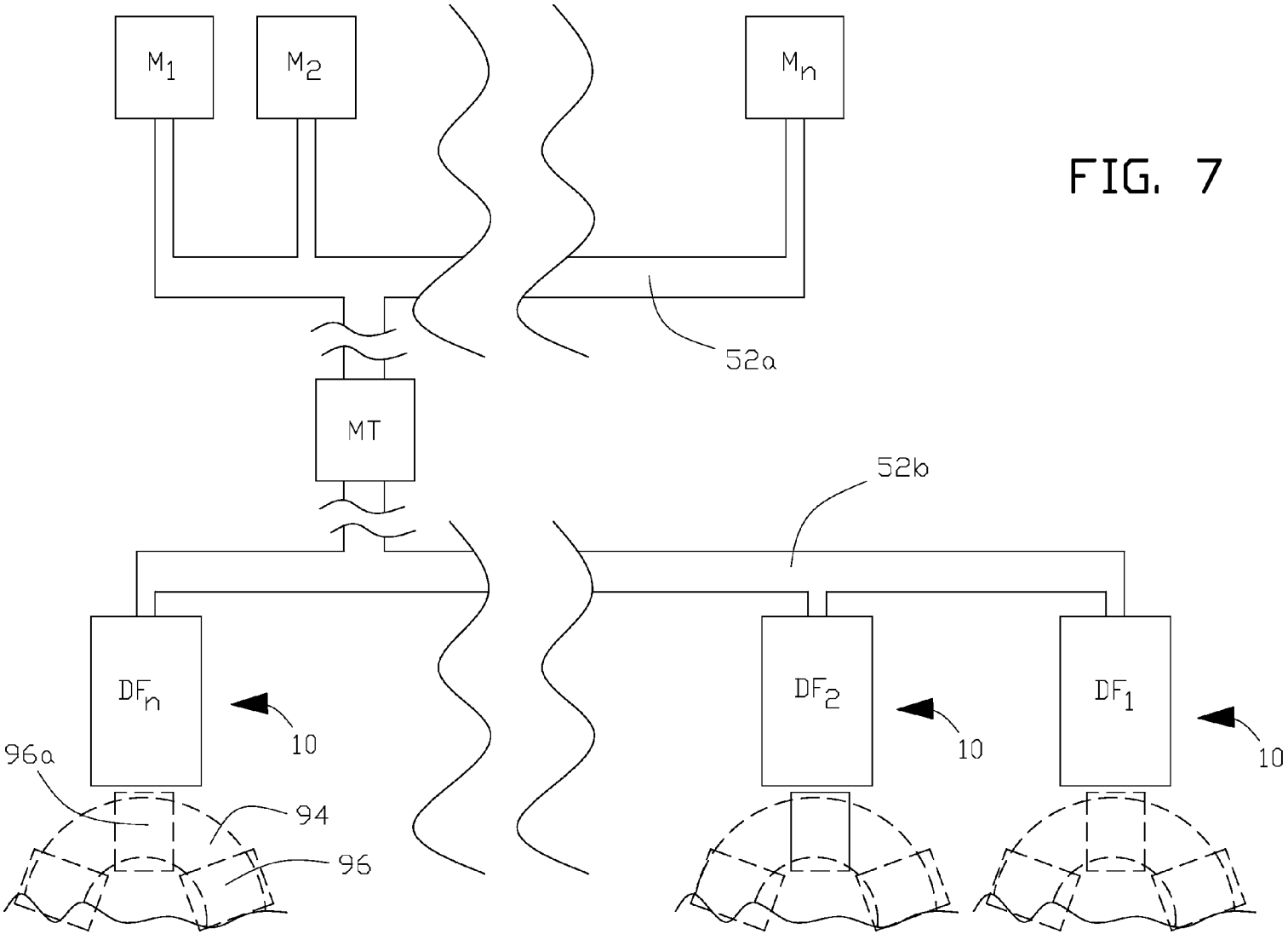
FIG. 7 diagrammatically illustrates one example of an integrated arrangement of molten metal supply sources, molten metal heat treatment vessels and the molten metal pressure pour furnaces of the present invention.
Figure 8A:
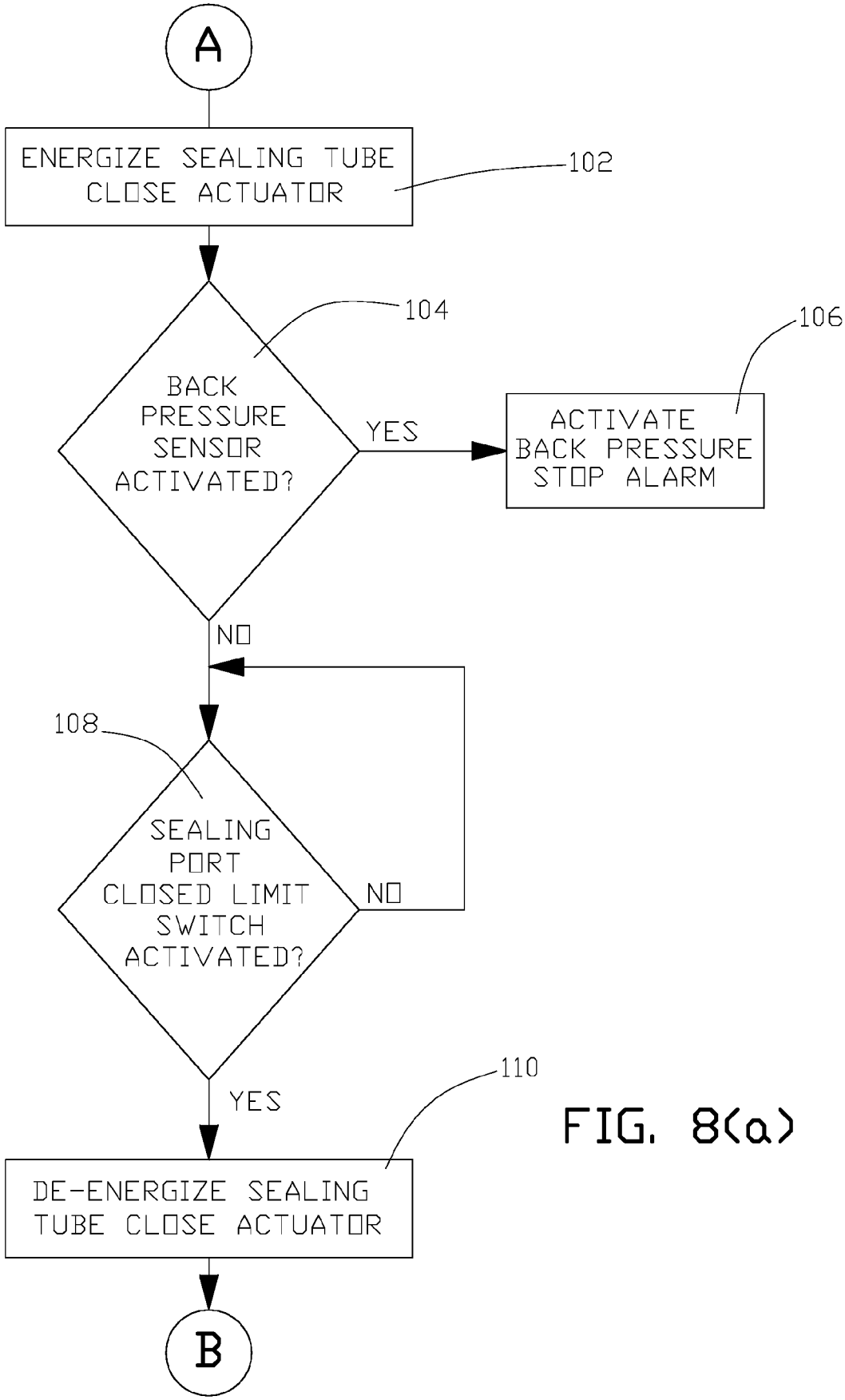
FIG. 8(*a*) through FIG. 8(*h*) is a flowchart of an example of a control process that can be used for the molten metal pour furnace of the present invention.
Figure 8B:
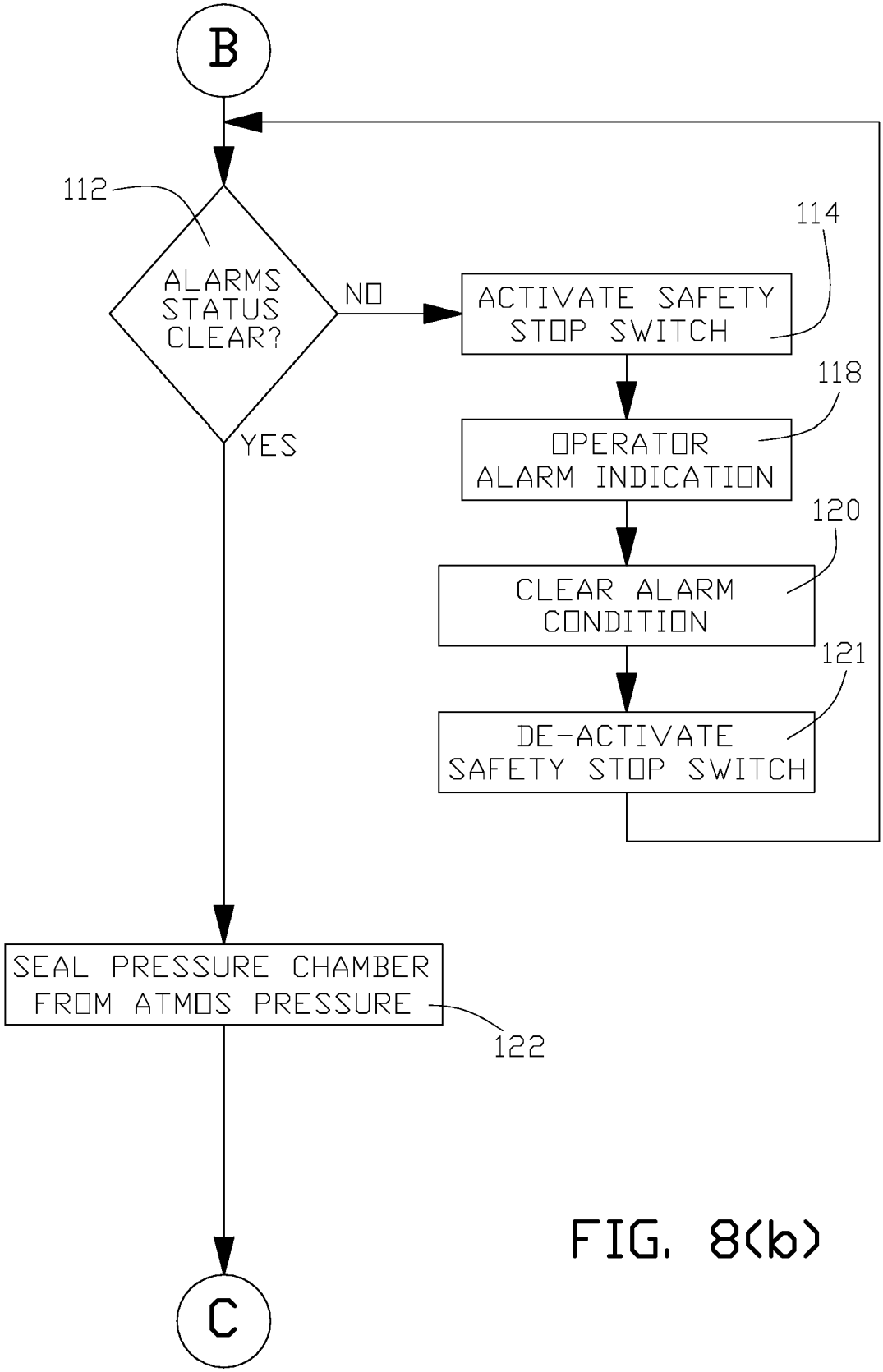
Figure 8C:
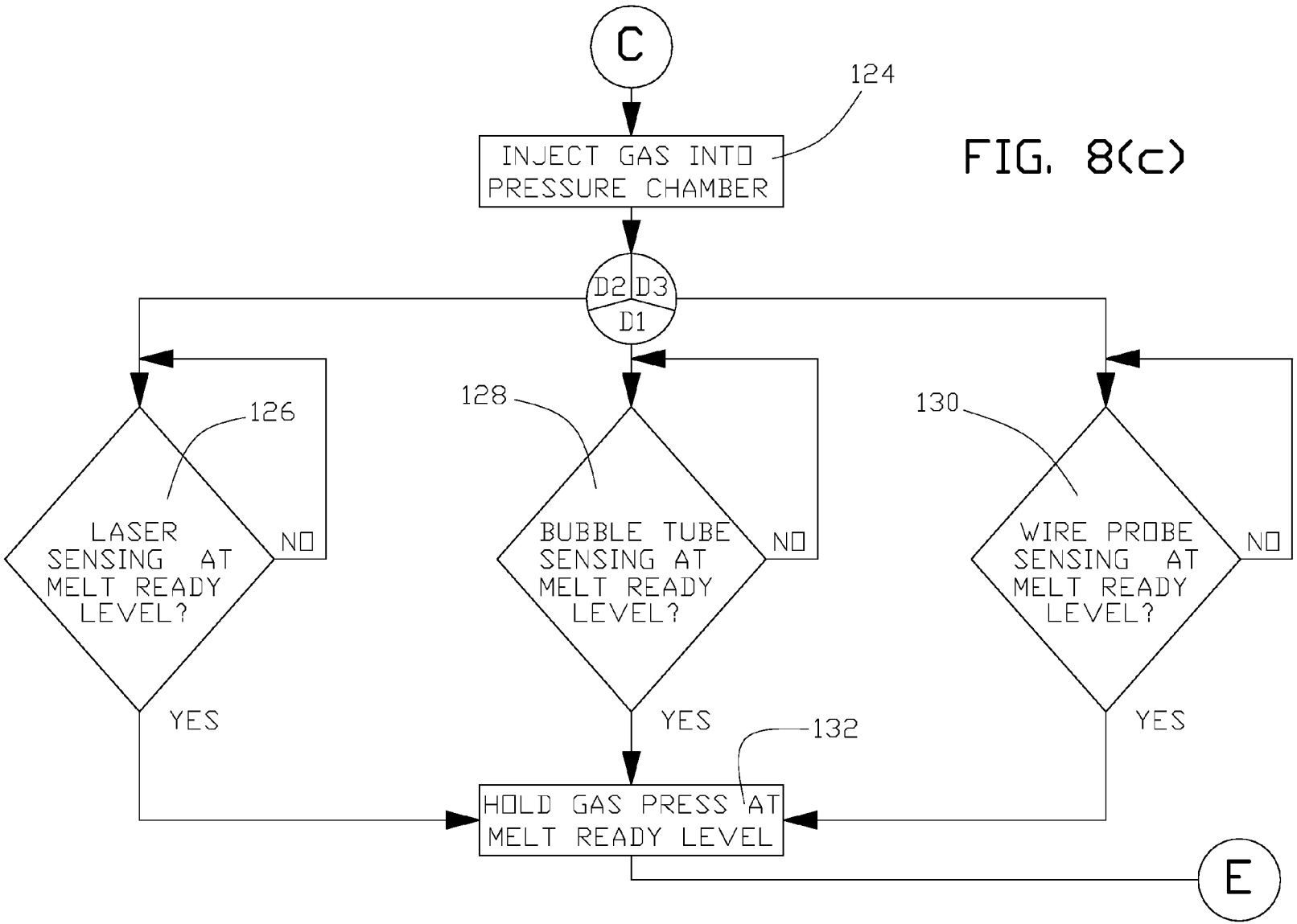
Figure 8D:
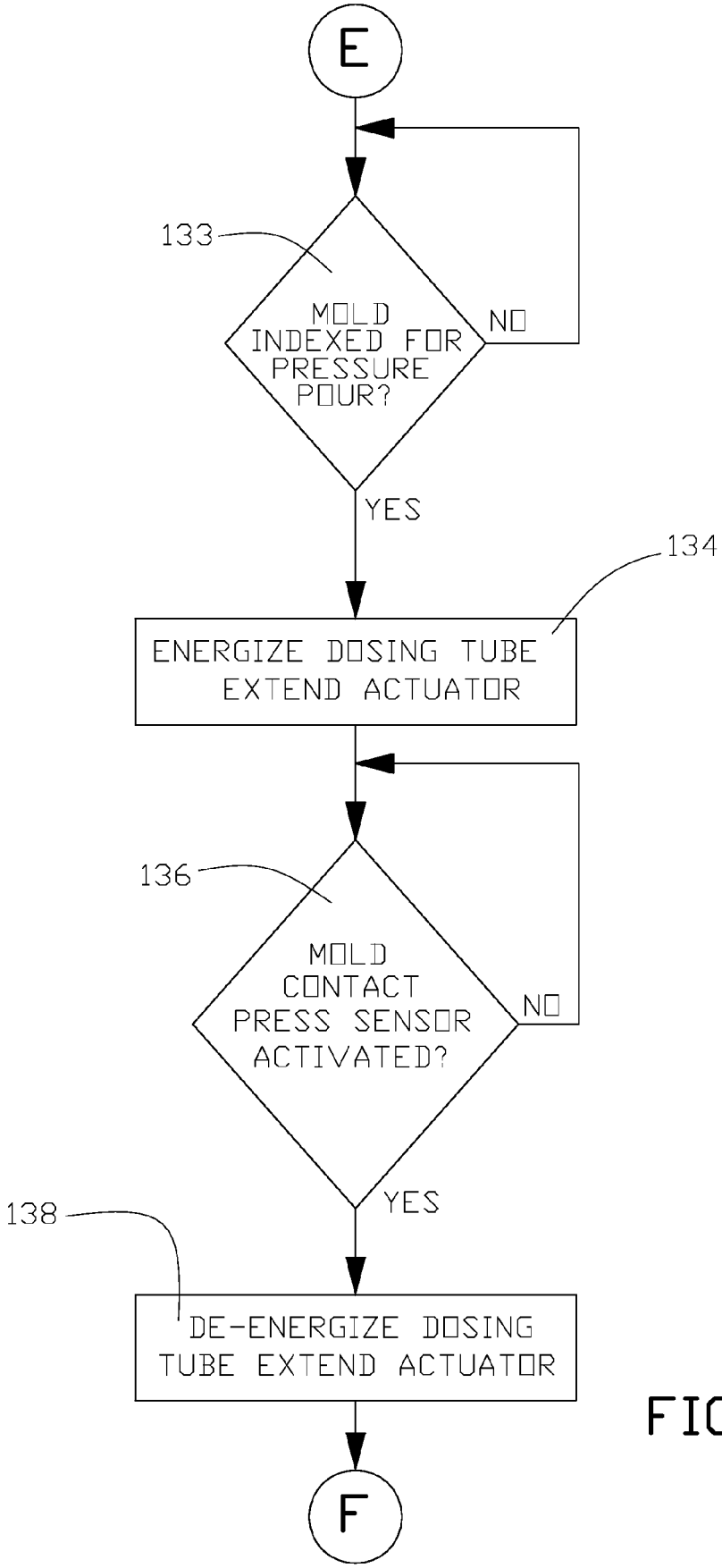
Figure 8E:
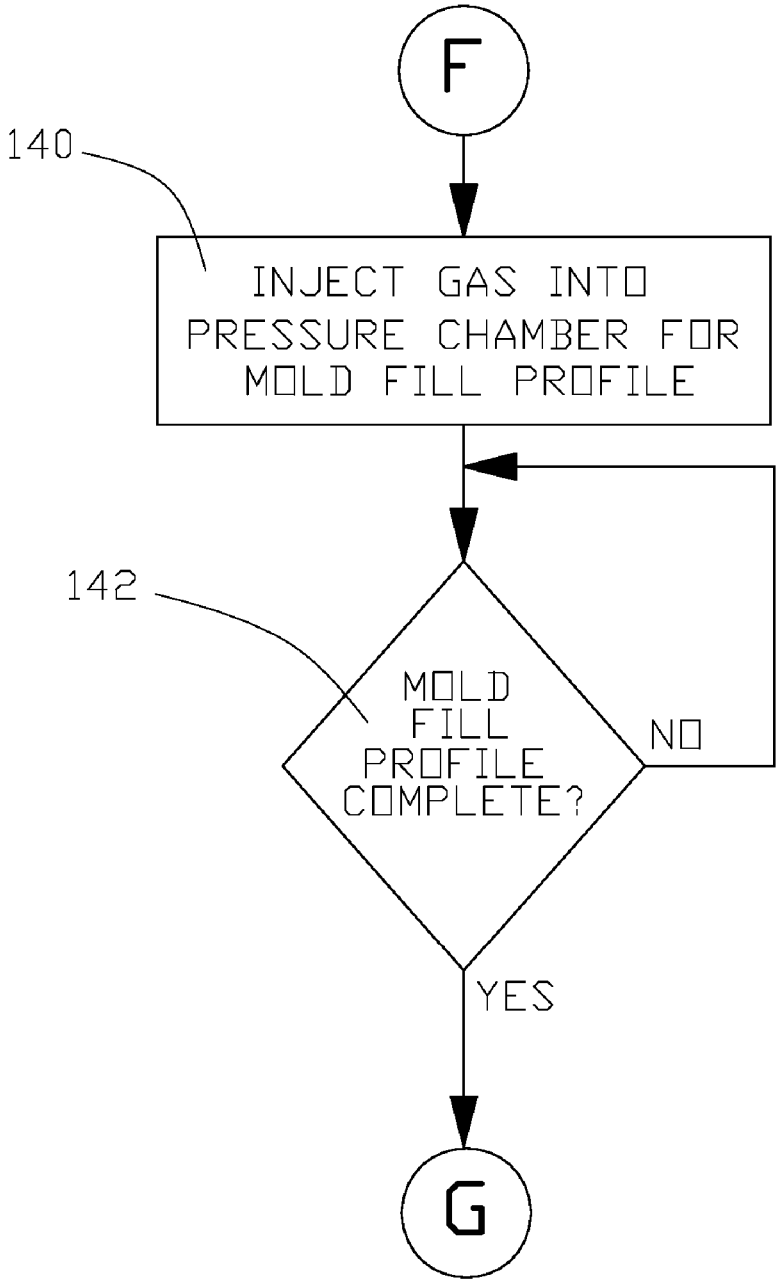
Figure 8F:
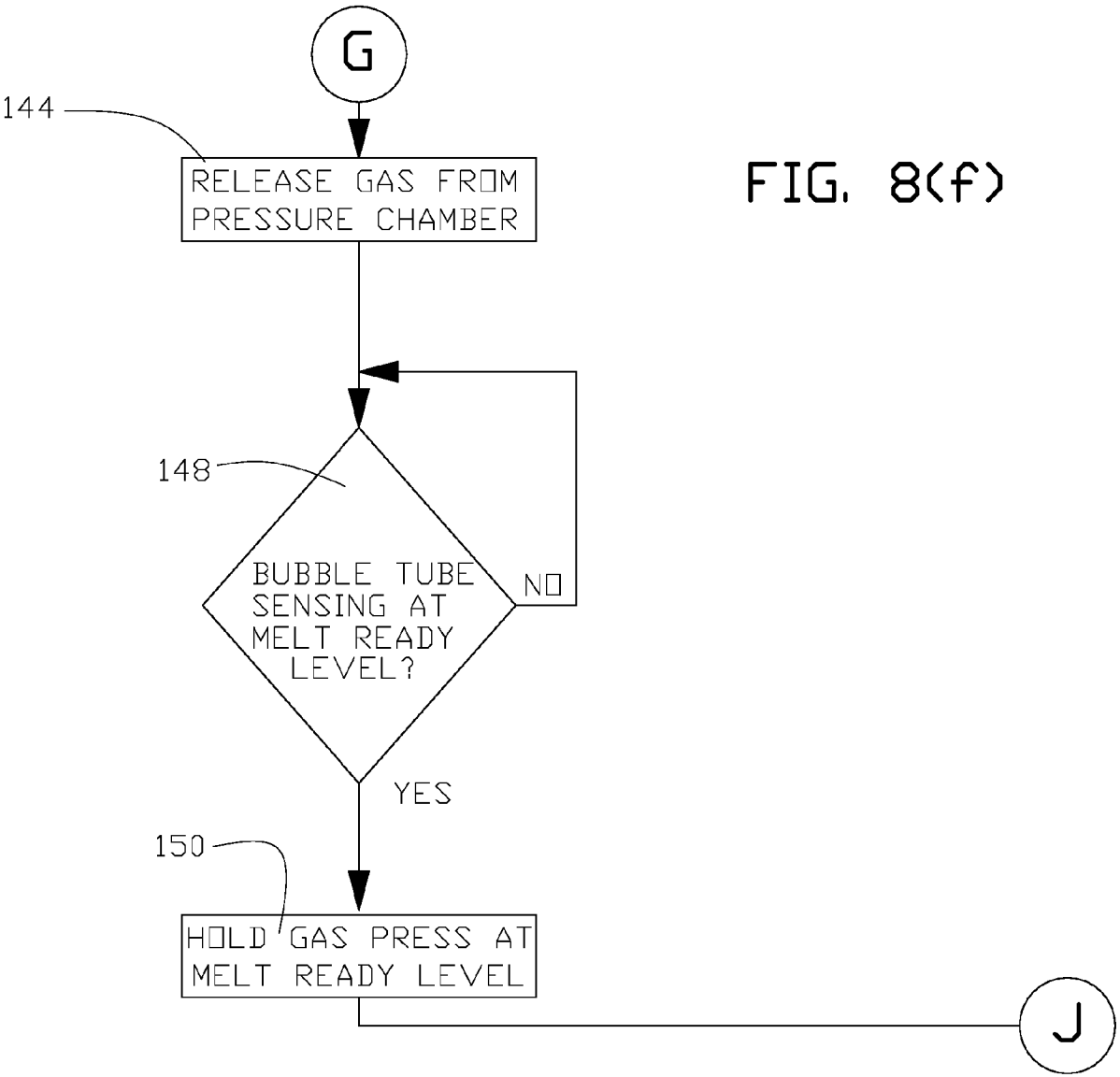
Figure 8G:
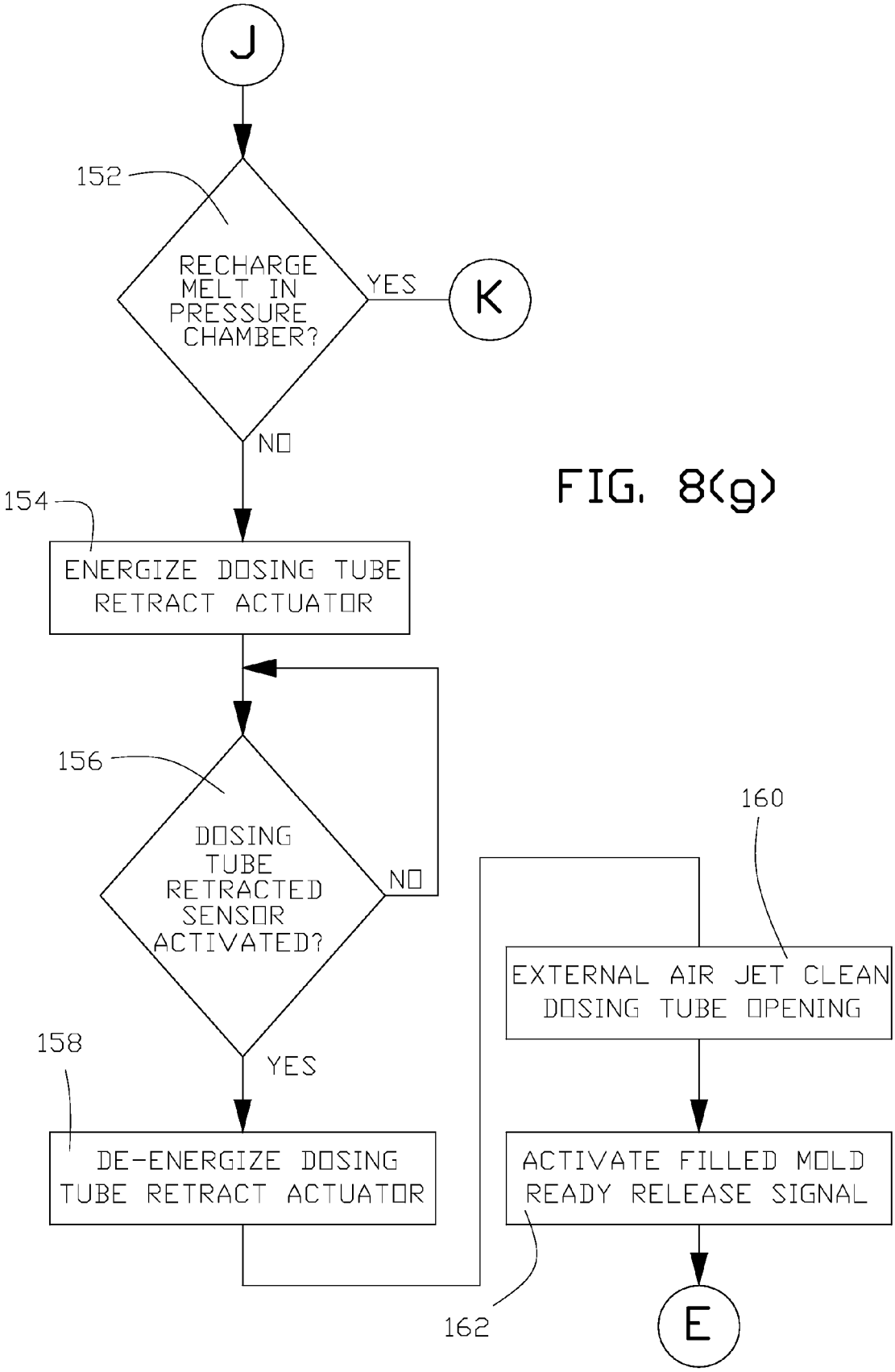
Figure 8H:
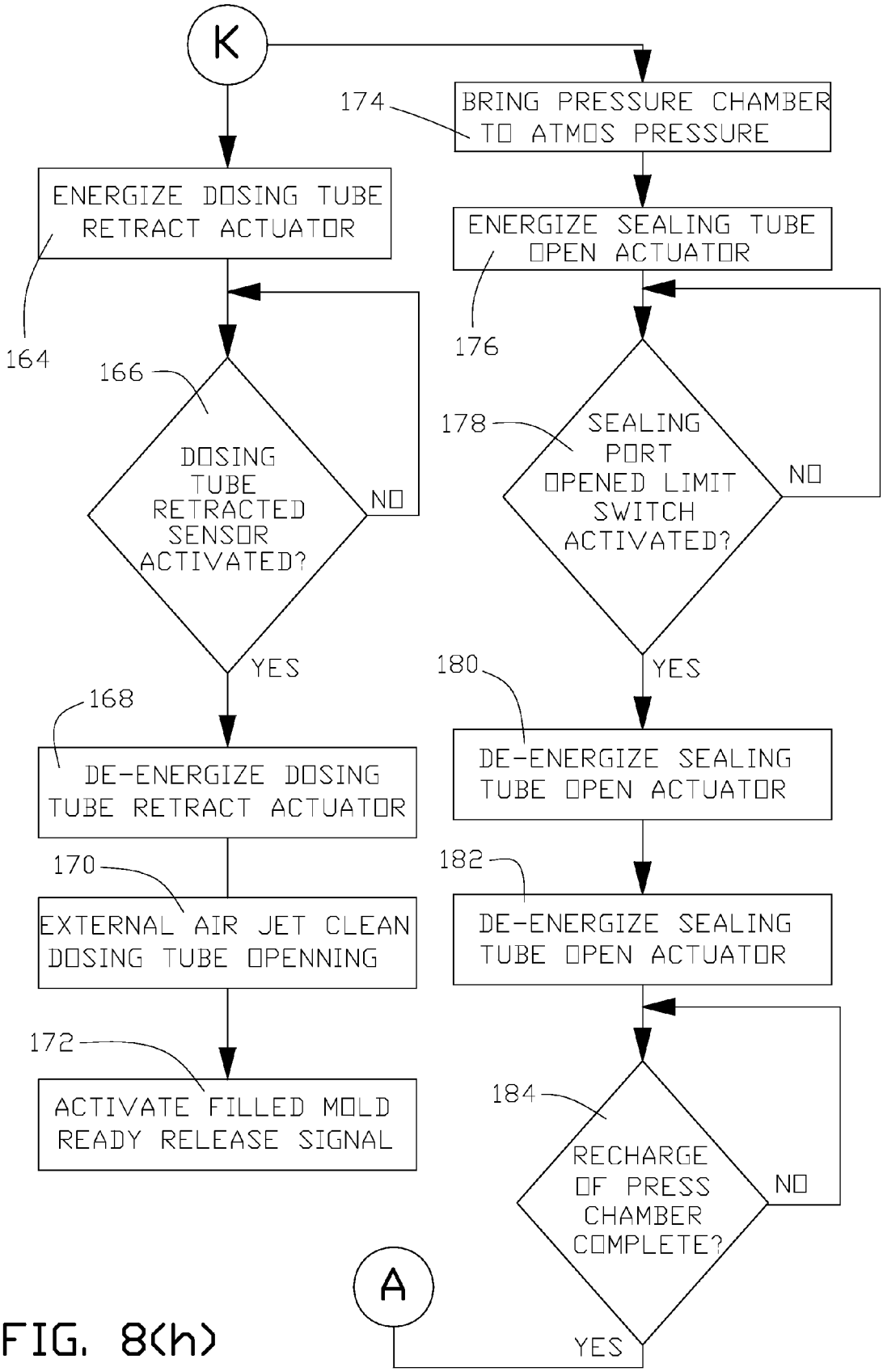

FIG. 7 diagrammatically illustrates one example of an integrated arrangement of molten metal supply sources, $M_1$ through $M_n$ feeding a supply launder distribution network 52*a,* that can be optionally connected to a furnace launder distribution network 52*b* via one or more metal treatment vessels (MT), or directly to the furnace launder distribution network. The molten metal supply sources can be metal melting furnaces, such as vertical stack scrap and/or ingot aluminum, or other metal charge, melting furnaces, as known in the art. The metal treatment vessels provide a means for treating the molten metal output from the melting furnaces, such as the removal of hydrogen gas, oxides, impurities and other active metals in the molten metal, as known in the art. The furnace launder distribution network 52*b* supplies the molten metal to a plurality of molten metal pressure pour furnaces 10 of the present invention (designated $DF_1$ through $DF_n$ in FIG. 7). Molten metal pressure pour furnaces 10 discharge doses of the molten metal as described herein. Mold transport machinery 94 is diagrammatically illustrated with exemplar molds 96 being transported to and from each furnace for sequential indexing in position (mold 96*a*) for filling from pressure pour furnace 10. The launder distribution networks are typically configured as an open heated trough and can be arranged for gravity flow of the molten metal from the supply source to the molten metal pressure pour furnaces.

Figure 9A:
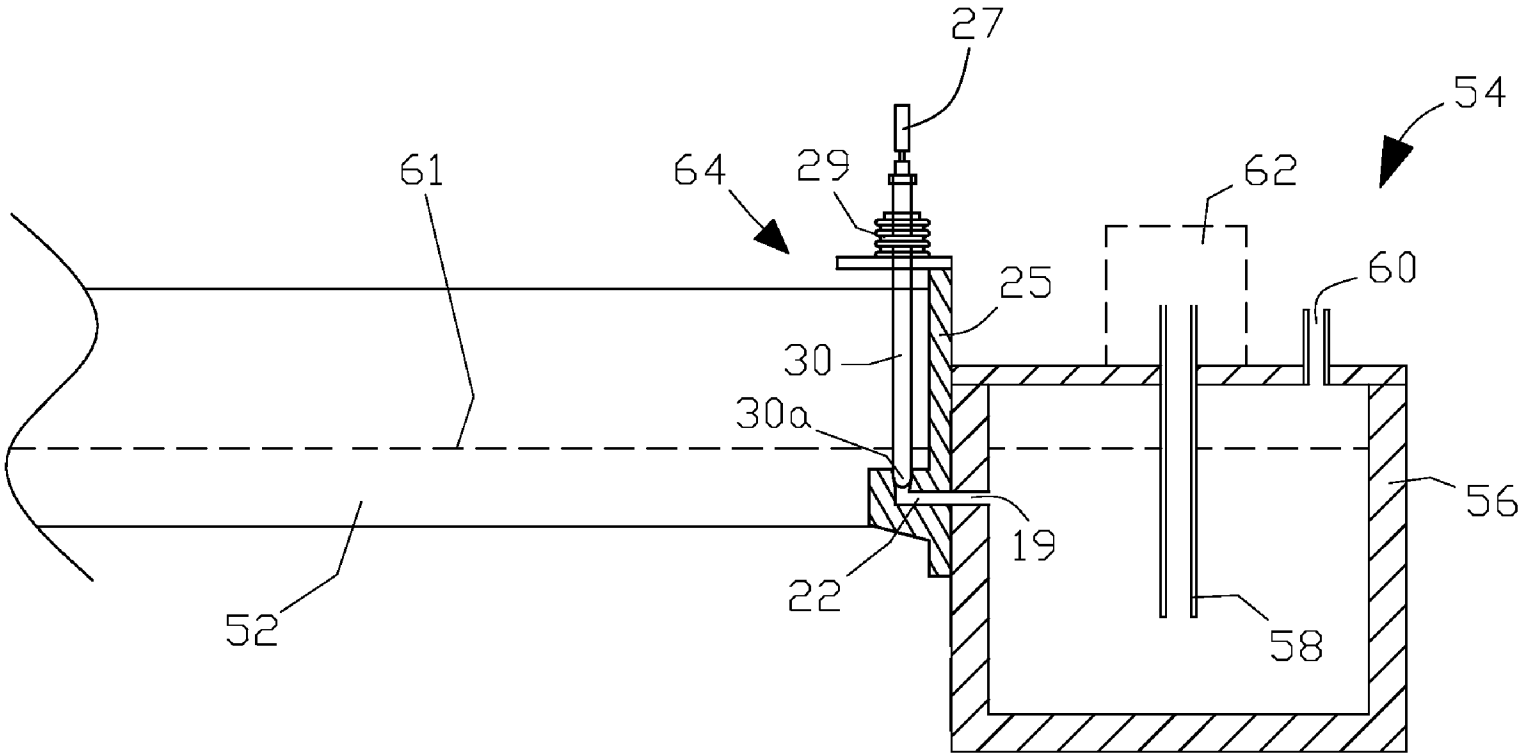
FIG. 9(*a*) illustrates a metering valve of the present invention that is used to regulate the flow of a molten metal into a low pressure pour furnace.
Figure 9B:
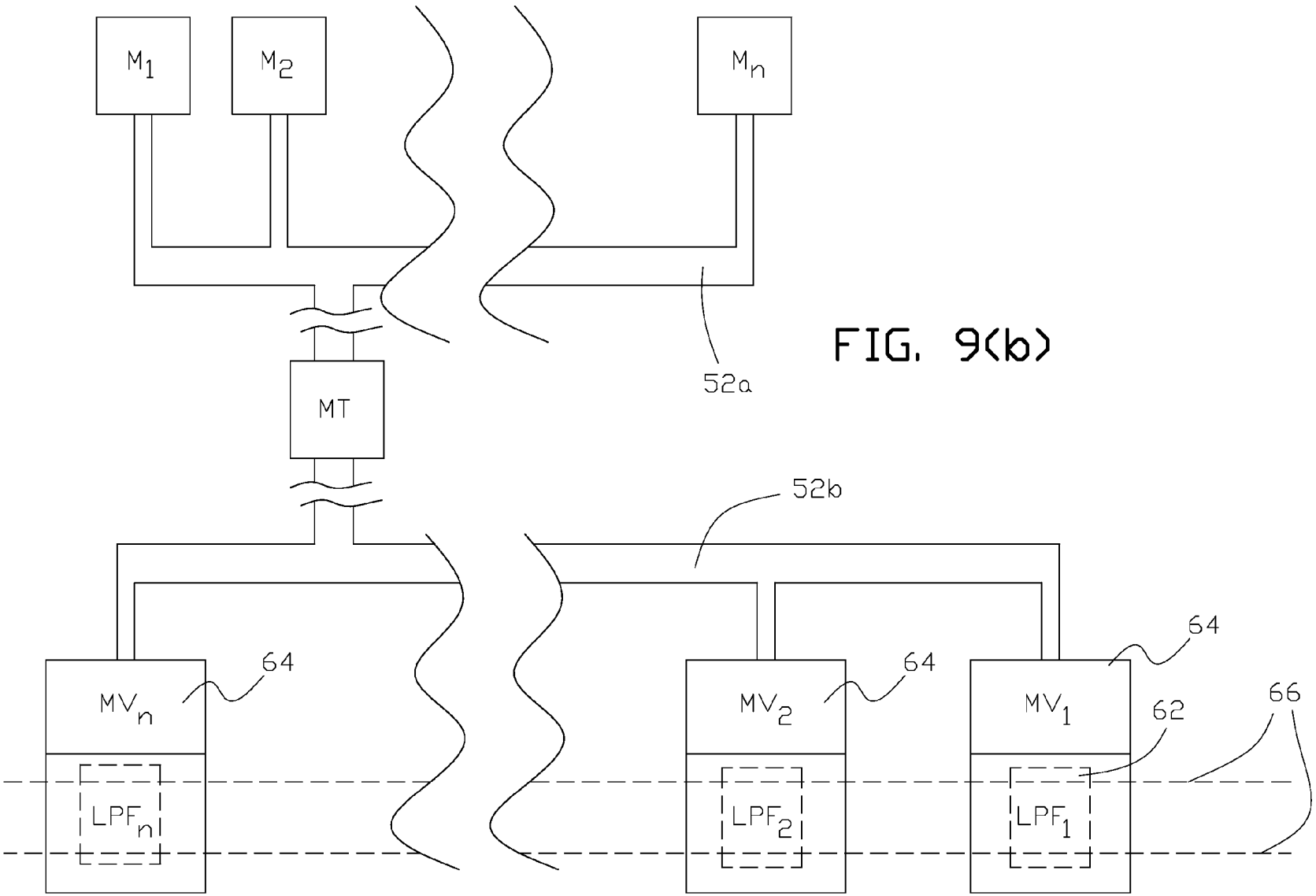

The metering valve of the present invention may also be used to control the flow of a molten metal between any adjoining molten metal containing components other than the heating chamber and pressure chamber of a molten metal pressure pour furnace. For example, FIG. 9(*a*) illustrates metering valve 64 of the present invention comprising a sealing port 22 and sealing means, such as sealing element 30*a* at one end of sealing tube 30. In this arrangement of the invention the adjoining molten metal containing components are launder 52 and pressure chamber 56 of low pressure molten metal furnace 54. Opening 19 in a wall of the pressure chamber is generally aligned with the outlet of sealing port 22. The launder is typically an open channel using gravity flow of molten metal to the pressure chamber, but may also be an enclosed component and employ other means for achieving the flow of molten metal. The launder may be heated (e.g., by electric heating elements) to keep the molten metal in it at a desired temperature. In a low pressure melt furnace, the melt is displaced vertically upwards through supply tube 58 and into the cavities of mold 62, which is indexed on top of the pressure chamber by mold line machinery (not shown in the drawing). Melt in the pressure chamber is forced up the supply tube by injecting a gas at a low pressure into gas port 60. A low pressure is used so that the mold's cavities fill slowly upwards to ensure that there is no entrained air in the die. After one or more molds are filled in this manner, the melt in the pressure chamber must be replenished. Sealing port 22 of metering valve 64 is opened by removing sealing element 30*a* from the sealing port as previously described, after the pressure chamber has been depressurized. Melt from launder 52 flows through the sealing port and into pressure chamber 56 through opening 19, preferably until the level of the melt in the pressure chamber is at the same level as it is in the launder. This level is illustrated by molten metal load line 61 in FIG. 9(*a*) (shown as a dashed line). Upon recharging pressure chamber 56 with molten metal, the metering valve is closed by inserting sealing element 30*a* in the sealing port as previously described above. Since generally in this example of the invention, metering valve 64 does not protrude into a pressurized chamber, bellows 29 is an optional component. Sealing plate 25 in this non-limiting example of the invention, is shown as a separate element that is attached to a wall of connecting low pressure chamber 56. In other examples of the invention, the sealing plate may be incorporated into the connecting wall of the low pressure chamber, and the cylindrical end of sealing port 22 of metering valve 74 would open directly into the interior of the pressure chamber, rather than through intervening opening 19. FIG. 9(*b*) diagrammatically illustrates an integrated arrangement of molten metal supply sources, $M_1$ through $M_n$ feeding a supply launder distribution network 52*a,* that can be optionally connected to a furnace launder distribution network 52*b* via one or more metal treatment vessels (MT), or directly to the furnace launder distribution network. The furnace launder distribution network 52*b* supplies the molten metal to a plurality of low pressure furnaces, $LPF_1$ through $LPF_n$. The flow of molten metal to each low pressure furnace is controlled by a metering valve 64. Mold transport machinery is diagrammatically illustrated by dash lines 66. The mold transport machinery line delivers empty molds to, and receives full molds from, each low pressure furnace. Mold 62 illustrates a mold indexed for fill from low pressure furnace $LPF_1$.

Figure 10A:
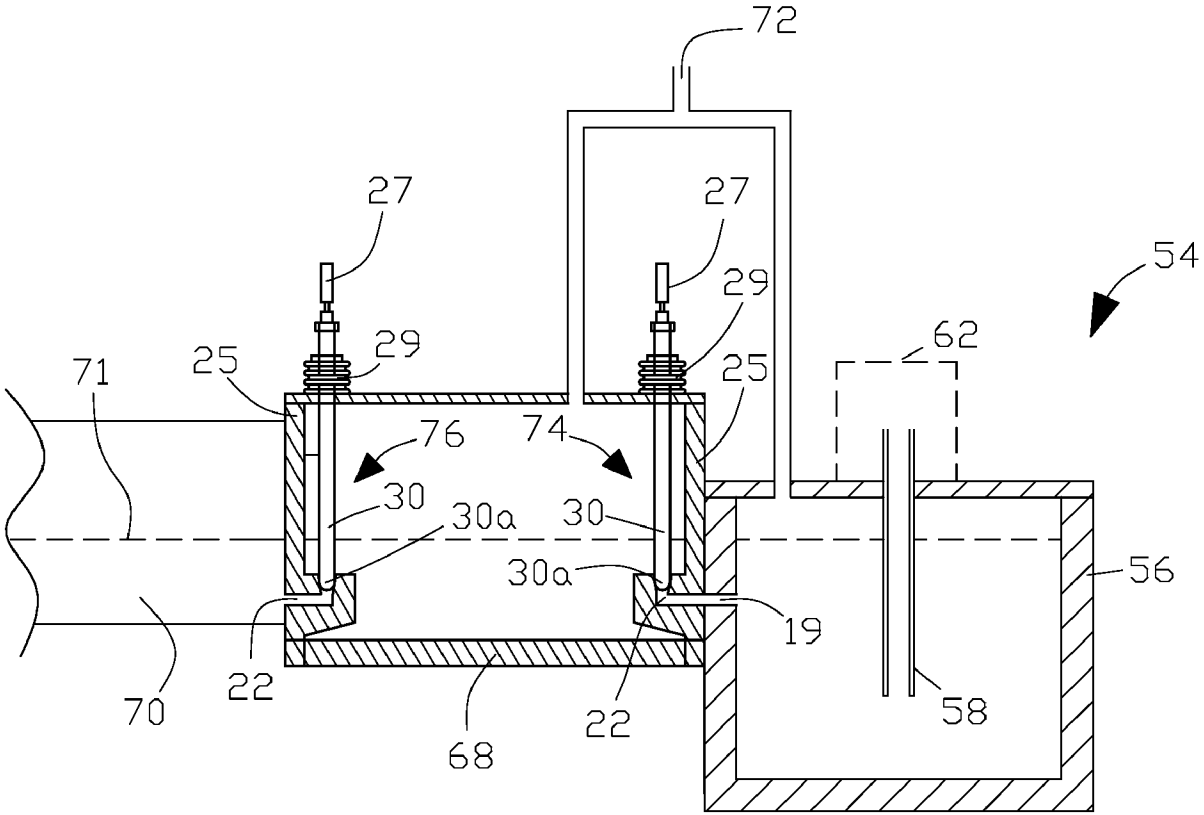
FIG. 10(*a*) illustrates a double metering valve arrangement of the present invention that is used to regulate the flow of a molten metal into a low pressure pour furnace.
Figure 10B:
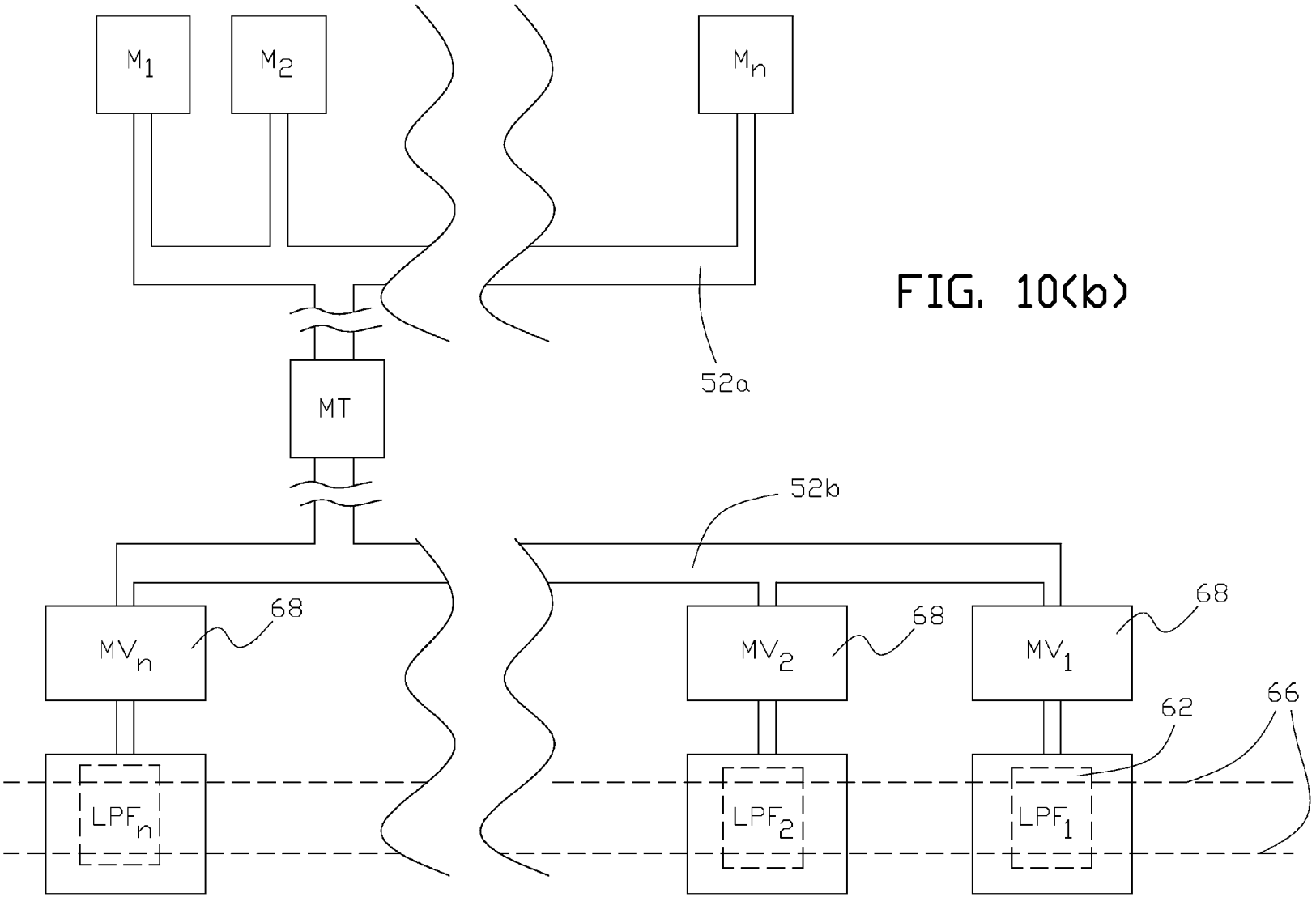

FIG. 10(*a*) illustrates an alternative method of controlling the flow of molten metal to a low pressure furnace. In this method a double metering valve chamber 68 of the present invention is used. Double metering valve chamber 68 is connected between launder 70 and pressure chamber 56 of low pressure molten metal furnace 54. As shown in FIG. 10(*a*), each of the two metering valves, 74 and 76 in the double metering valve chamber comprise a sealing port 22 in sealing plate 25, and sealing means, such as sealing element 30*a* at one end of sealing tube 30. In this example of the invention, the two sealing plates form walls of the double metering valve chamber. Opening 19 in a wall of the pressure chamber is generally aligned with the outlet of the sealing port for the metering valve adjacent to the wall. When melt in pressure chamber 56 of molten metal pressure furnace 54 must be replenished, both metering valves are opened by removing sealing elements 30*a* from their respective sealing ports as previously described, after the pressure chamber has been depressurized. Molten metal in the double metering valve chamber and launder 70 flows into pressure chamber 56 through the two open sealing ports and opening 19 in the pressure chamber's wall preferably until the level of the melt in the pressure chamber is at the same level as it is in launder 70 and double metering valve chamber 68. This level is illustrated by molten metal load line 71 in FIG. 10(*a*) (shown as a dashed line). Upon completion of recharging pressure chamber 56 with molten metal, metering valve 74 is closed by inserting sealing element 30*a* in its sealing port as previously described above. Metering valve 76 may alternatively be closed at the same time as metering valve 74, or may remain open to allow refilling of the double metering valve chamber, after which time, metering valve 74 can be closed. Closure of metering valve 76 is accomplished by inserting sealing element 30*a* in its sealing port as previously described above.

After closure of metering valve 74, one or more molds are filled with melt in the pressure chamber by injecting a gas into gas port 72 to force molten metal up supply tube 58 and into the cavities of mold 62 that has been indexed by mold line transport machinery onto the top of the pressure chamber. Optionally as shown in FIG. 10(*a*) a gas pressure equal to the pressure applied to the melt in the pressure chamber can be applied to the melt in the double metering valve chamber when both metering valves 74 and 76 are closed, if required to prevent a back flow of melt into the double metering valve chamber. If the double metering valve chamber is not pressurized, bellows 29 is optional for each metering valve. Sealing plate 25 in this non-limiting example of the invention for metering valve 74 adjacent to the wall of the pressure chamber, is shown as a separate element that is attached to a wall of connecting low pressure chamber 56. In other examples of the invention, the sealing plate may be incorporated into the connecting wall of the low pressure chamber, and the cylindrical end of sealing port 22 of metering valve 74 would open directly into the interior of the pressure chamber, rather than through intervening opening 19. FIG. 10(*b*) diagrammatically illustrates an integrated arrangement of molten metal supply sources, $M_1$ through $M_n$ feeding a supply launder distribution network 52*a*, that can be optionally connected to a furnace launder distribution network 52*b* via one or more metal treatment vessels (MT), or directly to the furnace launder distribution network. The furnace launder distribution network 52*b* supplies the molten metal to a plurality of low pressure furnaces, $LPF_1$ through $LPF_n$. The flow of molten metal to each low pressure furnace is controlled by a double metering valve chamber 68. Mold transport machinery is diagrammatically illustrated in similar fashion as that in FIG. 9(*b*).

While each of above examples of the invention utilize a single sealing port in a sealing plate, the scope of invention includes providing more than one sealing port in each sealing plate, with each of the sealing ports having appropriate sealing means to selectively control the flow of molten metal between the adjoining molten metal containing components.

The foregoing examples do not limit the scope of the disclosed invention. The scope of the disclosed invention is further set forth in the appended claims.

The invention claimed is:

1. A pressure pour furnace for discharge of a dose of a molten metal, the pressure pour furnace comprising:

a receiving chamber for receiving the molten metal from a source of the molten metal;

a heating chamber having an at least partially open inlet connected to the receiving chamber, the heating chamber having a means for heating the molten metal to a suitable temperature;

a pressure chamber having an at least one sealing port to control a flow of the molten metal from the heating chamber to the pressure chamber;

a sealing means for insertion into, or removal from, each of the at least one sealing port to prevent the flow of the molten metal through the sealing port, or to allow the flow of the molten metal through the sealing port;

a dosing tube protruding through a dosing tube opening in a wall of the pressure chamber;

a bellows attached at a first end to the wall of the pressure chamber around the dosing tube opening and attached at a second end to the outside of the dosing tube to provide a pressurized seal around the dosing tube opening;

a means for injecting a gas into the pressure chamber to force the molten metal in the pressure chamber out of the pressure chamber through the dosing tube; and a means for venting the pressure chamber to atmospheric pressure.

2. A pressure pour furnace for discharge of a dose of a molten metal, the pressure pour furnace comprising:

a receiving chamber for receiving the molten metal from a source of the molten metal;

a heating chamber having an at least partially open inlet connected to the receiving chamber, the heating chamber having a means for heating the molten metal to a suitable temperature;

a pressure chamber having an at least one sealing port to control a flow of the molten metal from the heating chamber to the pressure chamber, each one of the at least one sealing port attached to a sealing plate, the sealing plate substantially forming the boundary wall between the pressure chamber and the heating chamber to block the flow of the molten metal from the heating chamber to the pressure chamber except through the at least one sealing port;

a sealing means for insertion into, or removal from, each of the at least one sealing port to prevent the flow of the molten metal through the sealing port, or to allow the flow of the molten metal through the sealing port;

a dosing tube protruding through a dosing tube opening in a wall of the pressure chamber;

a means for providing a pressurized seal around the dosing tube opening;

a means for injecting a gas into the pressure chamber to force the molten metal in the pressure chamber out of the pressure chamber through the dosing tube; and a means for venting the pressure chamber to atmospheric pressure.

3. A pressure pour furnace for discharge of a dose of a molten metal, the pressure pour furnace comprising:

a receiving chamber for receiving the molten metal from a source of the molten metal;

a heating chamber having an at least partially open inlet connected to the receiving chamber, the heating chamber having a means for heating the molten metal to a suitable temperature;

a pressure chamber having an at least one sealing port to control a flow of the molten metal from the heating chamber to the pressure chamber;

a sealing means for insertion into, or removal from, each of the at least one sealing port to prevent the flow of the molten metal through the sealing port, or to allow the flow of the molten metal through the sealing port;

a dosing tube protruding through a dosing tube opening in a wall of the pressure chamber;

a means for providing a pressurized seal around the dosing tube opening;

a means for injecting a gas into the pressure chamber to force the molten metal in the pressure chamber out of the pressure chamber through the dosing tube;

a means for venting the pressure chamber to atmospheric pressure; and an immersion tube heater disposed in the pressure chamber to heat the molten metal in the pressure chamber.

4. A pressure pour furnace for discharge of a dose of a molten metal, the pressure pour furnace comprising:

a receiving chamber for receiving the molten metal from a source of the molten metal;

a heating chamber having an at least partially open inlet connected to the receiving chamber, the heating chamber having a means for heating the molten metal to a suitable temperature;

a pressure chamber having an at least one sealing port to control a flow of the molten metal from the heating chamber to the pressure chamber;

a sealing means for insertion into, or removal from, each of the at least one sealing port to prevent the flow of the molten metal through the sealing port, or to allow the flow of the molten metal through the sealing port;

a dosing tube protruding through a dosing tube opening in a wall of the pressure chamber;

a means for providing a pressurized seal around the dosing tube opening;

a means for injecting a gas into the pressure chamber to force the molten metal in the pressure chamber out of the pressure chamber through the dosing tube;

a means for venting the pressure chamber to atmospheric pressure; and a means of pressurizing the molten metal in the heating chamber to increase the time rate of refill of the pressure chamber when the at least one sealing port allows the flow of the molten metal through the sealing port.

5. A system for providing doses of a molten metal, the system comprising:

an at least one metal melting furnace for the production of the molten metal by heating a metal charge;

an at least one molten metal pressure pour furnace comprising:

a receiving chamber for receiving the molten metal from a source of the molten metal;

a heating chamber having an at least partially open inlet connected to the receiving chamber, the heating chamber having a means for heating the molten metal to a suitable temperature;

a pressure chamber having an at least one sealing port to control a flow of the molten metal from the heating chamber to the pressure chamber;

a sealing means for insertion into, or removal from, each of the at least one sealing port to prevent the flow of the molten metal through the sealing port, or to allow the flow of the molten metal through the sealing port;

a dosing tube protruding through a dosing tube opening in a wall of the pressure chamber;

a bellows attached at a first end to the wall of the pressure chamber around the dosing tube opening and attached at the second end to the outside of the dosing tube to provide a pressurized seal around the dosing tube opening;

a means for injecting a gas into the pressure chamber to force the molten metal in the pressure chamber out of the pressure chamber through the dosing tube; and a means for venting the pressure chamber to atmospheric pressure;

and a launder for transferring the molten metal from the at least one metal melting furnace to the receiving chamber of the at least one molten metal pressure pour furnace.

6. The pressure pour furnace of claim 1 further comprising a means for extending and retracing the dosing tube out of and into the pressure chamber.

7. The pressure pour furnace of claim 1 wherein the bellows comprises a first bellows section attached at a first end to the wall of the pressure chamber around the dosing tube opening and at a second end to a first connection around the outside of the dosing tube, and a second bellows section connected at a first end to the first connection around the outside of the dosing tube and at a second end to a second connection around the outside of the dosing tube, the second connection being near the external end of the dosing tube, wherein the first bellows section expands or contracts as the dosing tube is extended out of, or retracted into, the pressure chamber to maintain the pressurized seal and the second bellows section expands or contracts as the external end of the dosing tube moves away from the surface of a mold or moves towards the surface of a mold.

8. The pressure pour furnace of claim 2 wherein each of the at least one sealing port and the sealing plate are an integrally formed component.

9. The pressure pour furnace of claim 8 wherein the integrally formed component is cast from a high thermal conductivity ceramic.

10. The pressure pour furnace of claim 2 wherein the sealing means comprises a sealing element at a first end of a sealing tube, a second end of the sealing tube protruding through a sealing tube opening in a wall of the pressure chamber, and the pressure pour furnace further comprises a means for providing a pressurized seal around the sealing tube opening.

11. The pressure pour furnace of claim 10 further comprising a heating element in the sealing element to melt any molten metal frozen to the sealing tube.

12. The pressure pour furnace of claim 10 wherein the means for providing a pressurized seal around the sealing tube opening comprises a bellows attached at a first end to the wall of the pressure chamber around the sealing tube opening and attached at a second end to the outside of the sealing tube.

13. The pressure pour furnace of claim 2 wherein each of the at least one sealing port comprises a substantially conically-shaped opening having a generally vertically-oriented axial alignment, the substantially conically-shaped opening connected at its smaller diameter to a first end of a substantially cylindrically and elbow-shaped passage, a second end of the substantially cylindrically and elbow-shaped passage having a generally horizontally-oriented axial alignment, and the sealing means comprises a sealing element at a first end of a sealing tube, a second end of the sealing tube protruding through a sealing tube substantially pressure-sealed opening in a wall of the pressure chamber, the sealing means having a generally hemispherical shape for insertion into the substantially conically-shaped opening of each of the at least one sealing port.

14. The pressure pour furnace of claim 1 further comprising a means for sensing a ready level of the molten metal in the pressure chamber.

15. The pressure pour furnace of claim 14 wherein the means for sensing the ready level of the molten metal in the pressure chamber comprises a pair of separated conducting probes removably insertable into the end of the dosing tube protruding from the furnace, the ready level comprising the level of the molten metal in the dosing tube at which the molten metal completes an electrical circuit between the pair of separate conducting probes.

16. The pressure pour furnace of claim 14 wherein the means for sensing the ready level of the molten metal in the pressure chamber comprises a laser sensor disposed external to the pressure chamber, the laser sensor sensing the ready level of the molten metal in the dosing tube by the period of time for return of a laser beam to the sensor from the surface of the molten metal in the dosing tube.

17. The pressure pour furnace of claim 14 wherein the means for sensing the ready level of the molten metal in the pressure chamber comprises a gas pressure sensing tube for sensing the pressure of the melt at a point at an end of the sensing tube in the melt in the pressure chamber by adjusting the flow rate of a gas through the sensing tube so that approximately one bubble of gas per second rises through the melt from the end of the sensing tube when the melt in the pressure chamber is at the ready level.

18. The pressure pour furnace of claim 1 further comprising a means for drawing a vacuum above the surface of the melt in the pressure chamber when the at least one sealing port allows the flow of the molten metal through the sealing port to increase the time rate of refill of the pressure chamber.

19. The system of claim 5 further comprising an at least one metal treatment vessel, each of the at least one metal treatment vessel disposed in the launder between the at least one metal melting furnace and the at least one molten metal pressure pour furnace.

20. The system of claim 5 wherein at least one of the at least one molten metal pressure pour furnace further comprises a means for extending and retracing the dosing tube out of and into the pressure chamber.

21. The system of claim 5 wherein the means for providing a pressurized seal around the dosing tube opening comprises a bellows attached at a first end to the wall of the pressure chamber around the dosing tube opening and attached at the second end to the outside of the dosing tube.

22. The system of claim 5 wherein each one of the at least one sealing port is attached to a sealing plate, the sealing plate substantially forming the boundary wall between the pressure chamber and the heating chamber to block the flow of the molten metal from the heating chamber to the pressure chamber except through the at least one sealing port.

23. The system of claim 22 wherein the sealing means comprises a sealing element at a first end of a sealing tube, a second end of the sealing tube protruding through a sealing tube opening in a wall of the pressure chamber, and the at least one molten metal pressure pour furnace further comprises a means for providing a pressurized seal around the sealing tube opening.

24. The system of claim 23 wherein the means for providing a pressurized seal around the sealing tube opening comprises a bellows attached at a first end to the wall of the pressure chamber around the sealing tube opening and attached at a second end to the outside of the sealing tube.

25. The system of claim 22 wherein each of the at least one sealing port comprises a substantially conically-shaped opening having a generally vertically-oriented axial alignment, the substantially conically-shaped opening connected at its smaller diameter to a first end of a substantially cylindrically and elbow-shaped passage, a second end of the substantially cylindrically and elbow-shaped passage having a generally horizontally-oriented axial alignment, and the sealing means comprises a sealing element at a first end of a sealing tube, a second end of the sealing tube protruding through a sealing tube substantially pressure-sealed opening in a wall of the pressure chamber, the sealing means having a generally hemispherical shape for insertion into the substantially conically-shaped opening of each of the at least one sealing port.

* * * * *